US006569592B2

(12) United States Patent
Ishihara et al.

(10) Patent No.: US 6,569,592 B2
(45) Date of Patent: May 27, 2003

(54) IMAGE FORMING METHOD

(75) Inventors: Yuka Ishihara, Minamiashigara (JP); Katsumi Daimon, Minamiashigara (JP); Manabu Serizawa, Minamiashigara (JP); Hirokazu Hamano, Minamiashigara (JP); Norihito Fukushima, Minamiashigara (JP); Takashi Imai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/014,565

(22) Filed: Dec. 14, 2001

(65) Prior Publication Data

US 2003/0054280 A1 Mar. 20, 2003

(30) Foreign Application Priority Data

Jul. 18, 2001 (JP) ..... 2001-218266

(51) Int. Cl.[7] ..... G03G 13/20
(52) U.S. Cl. ..... 430/124; 430/109.4
(58) Field of Search ..... 430/124, 109.4, 430/111.4; 399/330

(56) References Cited

U.S. PATENT DOCUMENTS

| | | | | |
|---|---|---|---|---|
| 5,627,000 | A * | 5/1997 | Yamazaki et al. | 430/99 |
| 6,203,956 | B1 * | 3/2001 | Urano et al. | 430/109 |
| 6,461,782 | B1 * | 10/2002 | Sasada et al. | 430/109.2 |
| 6,475,688 | B1 * | 11/2002 | Tamura et al. | 430/108.3 |

FOREIGN PATENT DOCUMENTS

| | | |
|---|---|---|
| JP | 42-23910 | 11/1967 |
| JP | 50-134652 | 10/1975 |
| JP | 51-23354 | 2/1976 |
| JP | 61-132972 | 6/1986 |
| JP | 1-163756 | 6/1989 |
| JP | 1-163757 | 6/1989 |
| JP | 2-79860 | 3/1990 |
| JP | 4-81770 | 3/1992 |
| JP | B2 4-24702 | 4/1992 |
| JP | B2 4-24703 | 4/1992 |
| JP | 4-155351 | 5/1992 |
| JP | B2 5-44032 | 7/1993 |
| JP | 9-329917 | 12/1997 |

* cited by examiner

*Primary Examiner*—John Goodrow
(74) *Attorney, Agent, or Firm*—Oliff & Berridge,PLC

(57) ABSTRACT

Provided is an image forming method capable of forming an image at a high speed, simultaneously performing a low temperature fusing property and hot offset resistance and controlling gloss. The image forming method includes a developing step of forming a toner image by developing an electrostatic latent image formed on a latent image holding member by a developer containing at least a toner, a transferring step of forming a transfer image by transferring the toner image formed on the latent image holding member onto a transfer material, and a fusing step of fusing the toner image transferred on the transfer material. In the image forming method, the toner contains at least a colorant and a binder resin in which a principal component is a crystalline resin and the fusing step is performed by a fusing apparatus having a heat-fixing roll and an endless belt.

16 Claims, 2 Drawing Sheets

IMAGE FORMING METHOD

BACKGROUND OF THE INVENTION

1. Field of the Invention

The present invention relates to a method for forming an image which is obtained by employing an electrophotographic apparatus utilizing an electrophotographic process such as a copying machine, a printer and a facsimile.

2. Description of the Related Art

In an electrophotographic process, multiple methods such as a method disclosed in Japanese Patent Laid-Open No. 23910/1967 have been known. Ordinarily, a fixed image is formed through plural processes in which a latent image is electrically formed by various ways on a photosensitive material utilizing a photoconductive substance, this latent image is developed using a toner, the thus-developed toner latent image on the photosensitive material is transferred onto a transfer material such as paper and a sheet to reveal a toner image either via or not via an intermediate transfer material, then, the thus-transferred image is fixed on the transfer material such as the paper and the sheet The photosensitive material is optionally cleaned to remove the toner left thereon by various types of ways and the thus-removed toner is provided again in the plural processes described above.

As for a fusing technique for fusing the transferred image which has been transferred on a surface of the transfer material, a fusing method utilizing a heat roil system in which the transfer material (herein also optionally referred to as paper or sheet) on which the toner image is transferred is inserted into between a pair of rolls including a heating roll and a pressure roll to fuse the toner image. Such fusing method can obtain a firmly fused image at a high speed compared with other fusing methods whereupon energy efficiency is high and a detrimental effect to environment to be caused by vaporization of a solvent is small.

In recent years, an effort for increasing a copying speed has been paid in a field of the copying machines for the purpose of enhancing productivity, however, when fusing is executed at a higher speed by using a fusing apparatus of a nip roll system, it is necessary that same quantities of thermal energy and pressure as those in a case at a low speed are added to the toner and the paper. For this reason, it is necessary that a width of a pressure-contact portion (hereinafter referred to as "nip") of a roll becomes larger in proportion with a process speed. As for a method of widening a nip width, there exist a method of increasing a load between the rolls, a method of increasing a thickness of an elastic body and a method of increasing a diameter of the roll. In the method of increasing the load or the method of increasing the thickness of the elastic body, a shape of a nip along a width direction may come to be uneven derived from a strain of the roll to cause a fusing unevenness or generation of a wrinkle on paper, hence, there intrinsically is a limitation on the load to be applied and a thickness of the elastic body. Further, in the method of increasing the diameter of the roll, though there is no such a quality problem of as described above, there is a problem that a size of the apparatus becomes large whereby a time (also referred to as warm-up time) for raising a temperature of the roll from a room temperature to a fixable temperature is prolonged.

In order to solve these problems and correspond to an increase of speed in operation, a method of using an endless belt (hereinafter referred to as "belt-nip system") disclosed in Japanese Patent Laid-Open No. 132972/1986 has been propose. A fusing apparatus of the belt-nip system has an endless belt which is tightly stretched between plural support rolls in a rotatable manner, and a heat-fixing roll which forms the nip by contacting the endless belt Paper on which an undeveloped toner image is formed is allowed to pass through the nip formed by the heat-fixing roll and the endless belt to perform fixation by a pressure and a thermal energy generated in the nip. By taking such a constitution, a width of the nip to be formed by the endless belt and the heat-fixing roll can easily be larger than that formed by an ordinary nip-roll system whereby it becomes possible to correspond to the increase of speed in operation. Further, when compared at a same process speed, the constitution can be smaller in size than that of a fusing roll of the roll-nip system.

In the fusing method by means of the roll-nip system or the belt-nip system, the toner image and the roll or the belt arc contacted with each other whereupon, at the time of fusing, a phenomenon that a portion of the toner is stuck to the roll or the belt, that is, a so-called hot offset, is likely to occur. Particularly, when a fusing temperature of the fusing apparatus is high, an agglomerating force of the toner is deceased to cause a problem that the hot offset is likely to occur.

Further, in recent years, in order to decrease an energy consumption, it is desired that fusing can be performed at a lower temperature. Particularly, in order to attain a far higher degree of energy saving, it is desired to turn off electricity to the fusing apparatus when it is not in use whereupon it is necessary to raise a temperature of the fusing apparatus to a working temperature immediately after the apparatus is excited. For this reason, it is desirous to allow a heat capacity of the fixing apparatus to be as low as possible; however, on such an occasion, the temperature of the fusing apparatus tends to be fluctuated in a larger amplitude than usual. Namely, an overshoot of a temperature after the electricity is turned on becomes large and, at the same time, a decrease of a temperature derived from passing the paper becomes large. Further, a difference between temperatures of a portion through which the paper is passed and other portions to be derived when the paper having a width narrower than that of the fusing apparatus is continuously passed therethrough also become large. Particularly, in some case in which a high speed copying machine or printer is used, a power supply capacity is likely to be short whereupon such a tendency as described above is large. Therefore, the toner which can be fused at a low temperature and does not generate the hot offset up to a range of a far higher temperature, that is, has a wide fusing latitude is desired.

In order to decrease the fusing temperature of the toner, an adoption of a crystalline resin as a binder resin is proposed in Japanese Patent Laid-Opens No. 24702/1992, No. 24703/1992, and No. 329917/1997; however, though such a method as described above can decrease the fusing temperature, the hot offset resistance is not necessarily sufficient. Namely, though there is an effect of preventing generation of the hot offset to some extent by allowing a melted toner to be penetrated in paper, the melted toner tends to be excessively penetrated in the paper to cause a problem that an image having a uniform high density can not be obtained.

On the other hand, in order to prevent the generation of the hot offset, it is known that a low molecular weight polymer and a high molecular weight polymer are blended to produce a mixture which is then used as a binder resin of the toner containing a resin having an appropriate molecular weight distribution (disclosed in Japanese Patent Laid-Open No. 134652/1975) and it is also known that a resin having a crosslink therein is used (disclosed in Japanese Patent Laid-Open No. 23354/1975). However, these methods as described above can not obtain the wide fusing latitude enough to satisfy requirements of recent years. By using a large quantity of the high molecular weight polymer or a crosslinked polymer, it becomes difficult to generate the hot offset but, instead, the fusing temperature is increased. On the other hand, when a molecular weight of the low molecular weight polymer is decreased or a quantity of this polymer is increased in order to decrease the fusing temperature, a temperature of generating the hot offset is decreased. Further, the fusing temperature can be deceased either by decreasing a glass transition temperature (hereinafter also referred to as "glass transition point") or using a plasticizer, however, in this case, the toner is agglomerate-solidified in storage or in a developing apparatus, that is, a so-called blocking phenomenon easily occur.

For solving these problems, multiple techniques which do not use the crystalline polymer singly as a binder resin, but use it in combination with a non-crystalline polymer have been proposed as described below. To give some examples, it is disclosed in Japanese Patent Laid-Open No. 79860/1990 that the crystalline polymer and the non-crystalline polymer are simultaneously used; it is disclosed in Japanese Patent Laid Opens No. 163756/1989, No. 163757/1989, No. 81770/1992, No. 155351/1992, and No. 44032/1993 that the crystalline polymer and the non-crystalline polymer are chemically combined to produce a polymer. However, in a case in which a quantity of the non-crystalline polymer is larger than that of the crystalline polymer, the non-crystalline polymer becomes a continuous phase and the crystalline polymer becomes a dispersion phase. In this case, since the crystalline polymer is coated by the non-crystalline polymer, there is no problem to be caused by the crystalline polymer, on the other hand, since melting the entire tone is controlled by a softening temperature of the non-crystalline polymer, a low temperature fusing property can not be obtained.

Therefore, it means to request opposite characteristics that decrease of the fusing temperature and prevention of the hot offset are required at the same time; it is a present situation that the toner which can fully satisfy these characteristics at the same time has not been practically obtained.

Further, as a factor to be required for quality of a formed image, mentioned is gloss. It is preferable that the gloss can be controlled to be low when an image has a relatively low image density as a black-and-white image, while, though depending on a preference of a user, the gloss can be controlled to be in a relatively high range when the image has a high image density as a full-color image. Under these circumstances, in order to obtain the image having a high gloss, a polyester resin may be used as the binder resin and the toner containing the resin of a type having a larger storage elastic modulus $G_L$ than a loss elastic modulus $G_N$ may be used; however, on this occasion, the toner has a problem in hot offset resistance. On the other hand, in order to obtain the image having a low gloss, the toner containing the resin of a type having a relative high viscosity, and a larger loss elastic modulus $G_N$ than the storage elastic modulus $G_L$ may be used; however, on this occasion, the toner has a problem in the low temperature fusing property.

SUMMARY OF THE INVENTION

The present invention has been made in view of the above circumstances and provides a method of forming an image which solves the aforementioned problems present in the method of forming the image of the related art, is capable of forming the image at a high speed simultaneously, has a low temperature fusing property and hot offset resistance, and is capable of controlling gloss.

The present inventors have conducted intensive studies and found that a method of forming an image can be attained by selectively combining a specified fusing apparatus and a specified toner. The invention has been accomplished on the basis of this finding.

According to an aspect of the invention, the method of forming the image includes: a developing step of forming a toner image by developing an electrostatic latent image formed on a latent image holding member by a developer containing at least a toner, a transferring step of transferring the toner image formed on the latent image holding member onto a transfer material; and a fusing step of fusing the toner image on the transfer material. The toner contains at least a colorant and a binder resin in which a principal component is a crystalline resin, and the fusing step is performed by a fusing apparatus comprising a heat-fixing roll and an endless belt.

The fusing apparatus may include the heat-fixing roll which has a cylindrical core metal coated with a heat resistant elastic body layer and a heat resistant resin layer in this order and the endless belt having a pressure member inside, form a nip by winding the endless belt round the heat-fixing roll at a predetermined angle thereby allowing a recording sheet to pass through between the endless belt and the heat-fixing roll and generate strain on the heat resistant elastic body layer of the heat-fixing roll by urging the pressure member against the heat-fixing roll via the endless belt in the nip.

The heat resistant elastic body layer may be coated on the heat-fixing roll by a thickness of 0.5 mm or more.

The quantity $\epsilon$ of the strain in a circumferential direction of the heat resistant elastic body layer may satisfy the following formula:

$$\epsilon \geqq 0.5\%$$

In the toner, all of a storage elastic modulus $G_L(90)$ and a loss elastic modulus $G_N(90)$ at an angular frequency of 1 rad/s and 90° C. and the storage elastic modulus $G_L(30)$ and the loss elastic modulus $G_N(30)$ at an angular frequency of 1 rad/s and 120° C. are $1\times10^5$ Pa or less, and a relation between the storage elastic modulus $G_L(90)$ and the storage elastic modulus $G_N(120)$ may satisfy the following formula (1):

$$\log G_L(90) - \log G_L(120) < 2 \quad (1)$$

The melt viscosity of the toner at 120° C. may be 100Pa·S or more.

A melting point of the crystalline resin may be from approximately 50° C. to approximately 120° C.

The crystalline resin may be a crystalline polyester resin.

An ester concentration M defined by the following formula (2) of the crystalline polyester resin may be from approximately 0.01 to approximately 0.2:

$$M = K/A \quad (2)$$

where M represents a ester concentration, K represents a number of ester groups in a polymer, and A represents a number of atoms constituting a polymer chain of the polymer.

Alternatively, the crystalline polyester resin may be an aliphatic polyester resin.

The toner may be prepared by emulsifying the binder resin and adjusting a toner diameter by agglomerating and fusing the emulsified binder resin.

The toner may add a release agent internally by from approximately 0.5% by mass to approximately 50% by mass.

The storage elastic modulus $G_L(30)$ of the toner may be $1\times10^6$ or more and the loss elastic modulus $G_N(30)$ of the toner may be $1\times10^6$ or more at an angular frequency of 1 rad/s and 30° C.

The toner may have an area of temperature in which a change of a value of the storage elastic modulus $G_L$ and the loss elastic modulus $G_N$ is 1000 or more in a temperature range of 10° C.

The toner may contain two or more external additives, and an average primary particle size of at least one type of the external additives may be in a range of from approximately 30 nm to approximately 200 nm.

The developer that forms the toner image may contain a carrier as well as the toner, the carrier having a nitrogen-containing resin coating.

The nitrogen-containing resin may be selected from the group of a urea resin, a urethane resin, a melamine resin, an amide resin and mixtures thereof.

BRIEF DESCRIPTION OF THE DRAWINGS

Preferred embodiments of the present invention will be described in detail based on the following figures, wherein.

DETAILED DESCRIPTION OF THE INVENTION

Figure 1:
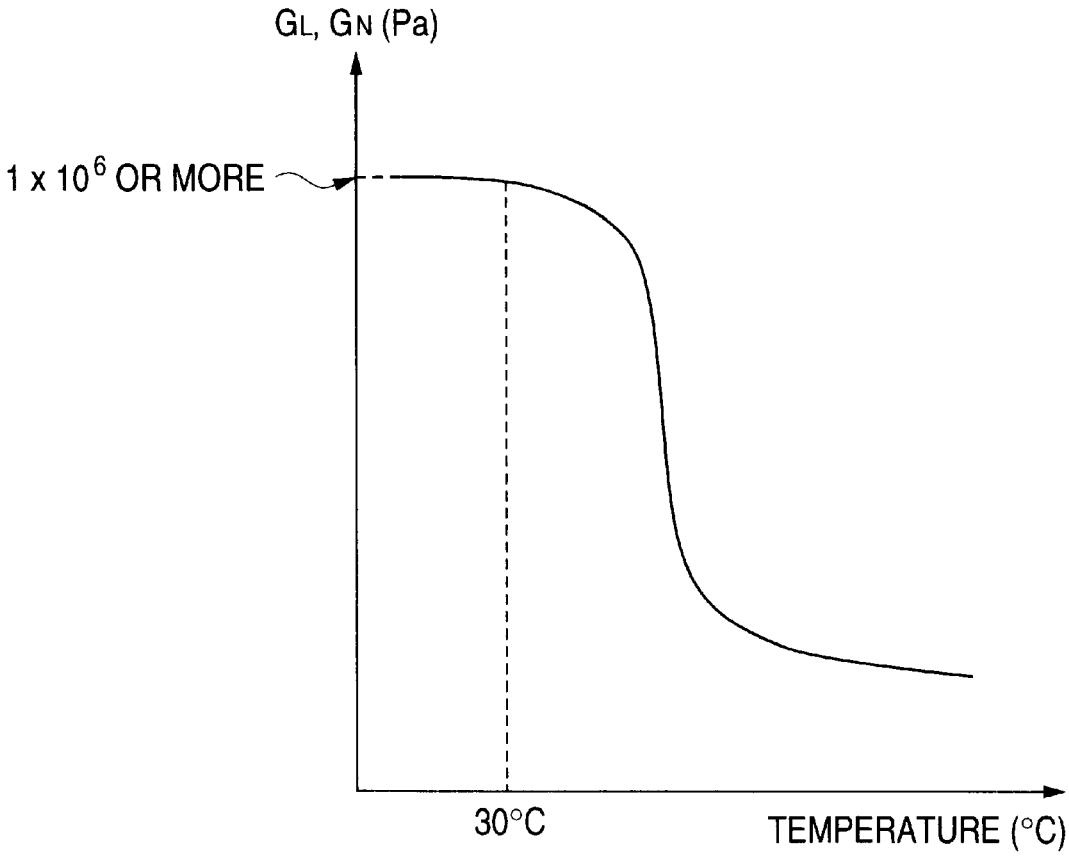
FIG. 1 is a graph showing preferred characteristics of a toner for an electrophotography according to the present invention, in which an axis of ordinates represents a common logarithm $\log G_L$ of storage elastic modulus or a common logarithm $\log G_N$ of loss elastic modulus and an axis of abscissas represents a temperature.

A method of forming an image according to the present invention includes a developing step for developing an electrostatic latent image formed on a latent image holding member by a developer containing at least a toner, a transfer step for transferring a toner image formed on the latent image holding member onto a transfer material and a fusing step for fusing the toner image transferred on the transfer material. In this method, the toner includes at least a colorant and a binder resin a principal component of which is a crystalline resin and, further, the fusing step is executed by a fusing apparatus provided with a heat-fixing roll and an endless belt Hereinafter, the method of forming the image according to the invention will be described in detail on each step included therein.

Developing Step

A developing step according to the present invention is a step which develops an electrostatic latent image formed on a latent image holding member by a developer containing at least a toner to form a toner image. In an electrophotography, an developer layer is formed on a surface of a developer carrier provided facing to the latent image holding member to develop the electrostatic latent image formed on the latent image holding member by the thus-formed developer layer.

The developer is substantially classified into 2 categories, that is, a one-component developer which includes a toner to be described below as it is and a two-component developer which includes the toner and a carrier. When the developer is the two-component developer including the toner and the carrier, the developer layer is formed such that a magnetic carrier is first formed on a surface of the developer holding member in a brush form and the toner is attached to the thus-formed magnetic carrier to form a so-called magnetic brush. The toner and the carrier to be used in the method of forming the image according to the invention will be described below.

Toner

A toner to be used in the method of forming the image according to the present invention includes at least a colorant and a binder resin a principal component of which is a crystalline resin and various types of components can be added thereto in accordance with purposes, so long as any one of them do not impair an effect of the method of forming the image according to the invention.

Hereinafter, components constituting the toner to be used in the method of forming the image according to the invention will be described one by one.

1. Binder Resin

A binder resin in a toner to be used in the method of forming the image according to the invention includes a crystalline resin as a principal component.

As used herein, the phraseology "principal component" is intended to include a pry component among components which constitute the binder resin and, specifically, refers to a component which constitutes 50% by mass or more of the binder resin. However, in the invention, the binder resin includes preferably 70% by mass or more of the crystalline resin and more preferably 100% by mass of the crystalline resin.

When the resin which constitutes the principal component of the binder resin is not crystalline, that is, non-crystalline, it is impossible to securing a favorable low temperature fusing property and, simultaneously, holding an anti-toner-blocking property and an image storing property. Further, in the invention, the phraseology "crystalline resin" is intended to include resins which do not show a stepped change of an endothermic quantity but show an endothermic peak when analyzed through differential scanning calorimetry (DSC).

A melting point of the crystalline resin which is the principal component of the binder resin to be used in the invention is in a range of, preferably, from 50° C. to 120° C. and, more preferably, from 60° C. to 110° C. When the melting point is less than 50° C., there is a case in which there is a problem in a storage property of the toner or the fused toner image. Further, when the melting point is more than 120° C., there is a case in which a sufficient low temperature fusing property can not be obtained compared with the toner of the related art.

Furthermore, in the invention, the melting point of the crystalline resin is determined by using a differential scanning calorimeter (DSC) and a value thereof can be obtained as a melting peak temperature by performing measurements while a temperature of the resin is raised from a room temperature to 150° C. at a temperature—raising rate of 10° C. a minute by means of an input-compensated differential scanning calorimetry defined by JIS K-7121. Still furthermore, the crystalline resin sometimes shows plural melting peaks; however, in the invention, a maximum peak is regarded as the melting point.

The crystalline resin constituting the principal component of the binder resin to be used in the invention is not limited in any particular way, so long as it has crystallinity;

specifically, mentioned are crystalline vinyl type resins and crystalline polyester resins.

Examples of the crystalline vinyl type resins include such vinyl type resins as being obtained by using long-chain alkyl or alkenyl esters of (meth)acrylic acid such as amyl (meth) acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate.

As used herein, the phraseology "(meth)acryl-" is intended to include at least any one of "acryl-" and "methacryl-".

As for the crystalline resin, a crystalline polyester resin is preferably used from the standpoint of adhesivity or charge property to a sheet at the time of fusing and capability of controlling a melting point to be within a preferred range. The crystalline polyester resin of aliphatic type having an appropriate melting point is more preferably used.

The crystalline polyester resin which is favorable as the crystalline resin will be described below.

Crystalline Polyester Resin

The crystalline polyester resin is synthesized from an acid (dicarboxylic acid) component (hereinafter also referred to as "constituent component derived from an acid") and an alcohol (diol) component (hereinafter also referred to as "constituent component derived from an alcohol"). The constituent component derived from the acid and the constituent component derived from the alcohol will be described in detail below.

In the invention, a copolymer which is prepared by copolymerzlng 50% by mass or less of other components based on the total mass of the crystalline polyester resin main chain is also designated as the crystalline polyester resin.

Constituent Component Derived from Acid

The above-described constituent component derived from the acid is preferably an aliphatic dicarboxylic acid and, more preferably, a linear carboxylic acid. Examples of such carboxylic acids include, though by no means limited to, oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, lower alkyl esters thereof and acid anhydrides thereof.

It is preferable that examples of the constituent components derived from the acids further include a constituent component derived from a dicarboxylic acid having a double bond, a constituent component derived from a dicarboxylic acid having a sulfonic group, other than the constituent components derived from the aliphatic dicarboxylic acids.

Examples of the constituent components derived from the dicarboxylic acids having a double bond further include constituent components derived from low alkyl esters or acid anhydrides of the dicarboxylic acids having a double bond, other than the constituent components derived from the dicarboxylic acids having a double bond. Also, examples of the constituent components derived from the dicarboxylic acids having a sulfonic group further include constituent components derived from low alkyl esters or acid anhydrides of the dicarboxylic acids having a sulfonic group, other than the constituent components derived from the dicarboxylic acids having a sulfonic group.

The dicarboxylic acid having a double bond can favorably be used, since a whole resin can be crosslinked by using the double bond therein to prevent the hot offset at the time of fusing. Examples of such dicarboxylic acids include, though by no means limited to, fumaric acid, maleic acid, 3-hexenedioic acid, 3-octenedioic acid, as well as low alkyl esters, and acid anhydrides thereof. Among others, fumaric acid, and maleic acid are preferable from the standpoint of cost.

The dicarboxylic acid having a sulfonic group is effective, since it can favorably disperse a colorant such as a pigment. Further, when a whole resin is emulsified or dispersed in water to produce fine particles, the presence of the sulfonic group therein can emulsify or disperse the whole resin without using an emulsifier as described below. Examples of such dicarboxylic acids having a sulfonic group include, though by no means limited to, sodium 2-sulfoterephthalate, sodium 5-sulfoisophthalate, sodium sulfosuccinate, as well as low alkyl esters, and acid anhydrides thereof. Among others, sodium 5-sulfoisophthalate is preferable from the standpoint of cost.

A content of each of these constituent components (the constituent component derived from the dicarboxylic acid having a double bond or the constituent component derived from the dicarboxylic acid having a sulfonic group or both) derived from the acids except constituent components derived from the aliphatic dicarboxylic acids in the constituent components derived from the acids is preferably from 1% by constitutional mol to 20% by constitutional mol and more preferably from 2% by constitutional mol to 10% by constitutional mol.

When such a content as described above is less than 1% by constitutional mol, dispersion of a pigment becomes insufficient or an emulsified particle size becomes large thereby causing difficulty in controlling a toner size owing to agglomeration, whereas, when the above-described content is more than 20% by constitutional mol, crystallinity of the polyester resin is decreased and the melting point thereof is decreased whereupon storage stability of the image is deteriorated or the emulsified particle size becomes so small that it is dissolved in water to hamper generation of a latex.

As used herein, the phraseology "% by constitutional mol" is intended to include a percentage to be obtained when each constituent component (constituent component derived from and acid or constituent component derived from an alcohol) in a polyester resin is designated as 1 unit (mol).

Constituent Component Derived from Alcohol

A constituent component derived from an alcohol is preferably an aliphatic diol; examples of such aliphatic diols include, though by no means limited to, ethylene glycol, 1,3-propane diol, 1,4-butane diol, 1,5-pentane diol 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol 1,18 octadecane diol, and 1,20-eicosane diol.

The constituent component derived from the alcohol which has the content of a constituent component derived from the aliphatic diol of 80% by constitutional mol or more is preferable and optionally contains other components. The constituent component derived from the alcohol which has the content of the constituent component derived from the aliphatic diol of 90% by constitutional mol or more is more preferable.

When the content is less than 80% by constitutional mol or less, there is a case in which crystallinity of the polyester resin is decreased and a melting point thereof is decreased whereupon an and-toner blocking property, storage stability of an image and a low temperature fusing property are deteriorated.

Examples of other components to be optionally contained therein include the constituent components derived from diols having a double bond, and the constituent components derived from diols having a sulfonic group.

Examples of the diols having a double bond include 2-butene-1,4-diol,3-butene-1,6-diol, and 4-butene-1,8-diol.

Examples of the diols having a sulfonic group include a sodium salt of 1,4-dihydroxy-2-sulfonic acid benzene, a sodium salt of 1,3-dihydroxy methyl-5-sulfonic acid benzene, and a sodium salt of 2-sulfo-1,4-butanediol and the like.

When other constituent components derived from alcohols (constituent components derived from the diol having a double bond or constituent components derived from the diol having a sulfonic group or both) than these linear-type aliphatic diols are added, a content of constituent component derived from such alcohols in the entire constituent component derived from the alcohol is preferably from 1% by constitutional mol to 20% by constituent component and more preferably from 2% by constitutional mol to 10% by constitutional mol.

When the content is less than 1% by constitutional mol, dispersion of a pigment becomes insufficient or an emulsified particle size becomes large thereby causing difficulty in controlling a toner size owing to agglomeration, whereas, when the content is more than 20% by constitutional mol, crystallinity of a polyester resin is decreased and a melting point thereof is decreased whereupon a storage stability of an image is deteriorated or the emulsified particle size becomes so small that it is dissolved in water to hamper generation of a latex.

A number-average molecular weight ($M_a$) of the crystalline polyester resin is preferably 1500 or more. When the number-average molecular weight is less than 1500, there is a problem that hot offset resistance is deteriorated.

The crystalline polyester resin in which an ester concentration M as defined by the following formula (1) is from 0.01 to 0.2 is preferable:

$$M=K/A \tag{1}$$

wherein M represents a concentration; K represents a number of ester groups in a polymer, and A represents a number of atoms constituting a polymer chain of a polymer.

As used herein, the phraseology "ester concentration M" is intended to include an indicator exhibiting a ratio of a content of ester groups in the polymer of the crystalline polyester resin and the phraseology "number of ester numbers in a polymer" represented by K in the formula is intended to include, in other words, a number of ester bonding contained in the total polymer.

As used herein, the phraseology "number of atoms constituting a polymer chain of a polymer" represented by A in the formula is intended to include total atoms constituting the polymer chain of the polymer which include the number of all atoms related with the ester bonding but does not include the number of atoms in a side chain portion at the point of other constitutional positions. Namely, carbon atoms and oxygen atoms (there are 2 oxygen atoms in 1 ester bond) derived from a carboxyl group or an alcoholic group which are related with the ester bond or carbon atoms, for example, 6 carbon atoms in an aromatic ring, constituting the polymer chain are included in the total atoms, wbereas hydrogen atoms, for example, those in an aromatic ring or an alkyl group, constituting the polymer chain, and atoms or a group of atoms in a substituent thereof are not included in the total atoms.

To give a specific example, atoms which are to be included in the "number A of atoms constituting a polymer chain" among 10 atoms made of 6 carbon atoms and 4 hydrogen atoms in an arylene group constituting a polymer chain are 6 carbon atoms only and, further, even when at least any one of the hydrogen atoms is replaced with any substituent, atoms constituting the substituent are not included in the "number A of atoms constituting a polymer chain".

When the crystalline polyester resin is a homopolymer containing only one repeating unit (for example, when a polymer is expressed by a formula, $H—[OCOR^1COOR^2O—]_n—H$, one repeating unit is shown by a portion inside the bracket), since there exist two ester bonds in one repeating unit (that is, the number of ester groups K' in one repeating unit is 2, namely, K'=2), an ester concentration M can be obtained by the following formula (1-1):

$$M=2/A' \tag{1-1}$$

wherein M represents an ester concentration; and A' represents a number of atoms constituting a polymer chain in one repeating unit.

Further, when the crystalline polyester resin is a copolymer containing plural copolymer units, a number of the ester groups and a number Ax of atoms constituting a polymer chain are first obtained and, then, the thus-obtained numbers are multiplied by a copolymer ratio and, thereafter, the thus-multiplied numbers are all added to produce a total number which is then assigned to the formula (1) to obtain an ester concentration. For example, an ester concentration M of a compound $[(Xa)_a(Xb)_b(Xc)_c]$ in which there are tree copolymer units, that is, Xa, Xb and Xc, and a copolymer ratio thereamong is a:b:c (on this occasion, a+b+c=1) can be obtained by the following formula (1-2):

$$M=\{K^{xa}xa+K^{Xb}xb+K^{Xc}xc\}/\{A^{xa}xa+A^{xb}xb+A^{xc}xc\} \tag{1-2}$$

wherein M represents an ester concentration; $K^{Xa}$, $K^{Xb}$ and $K^{Xc}$ represent numbers of ester groups in copolymer units Xa, Xb and Xc, respectively; and Axa, Axb and Axc represent numbers of atoms constituting an polymer chain in copolymer units Xa, Xb and Xc, respectively.

As for toners to be used in the invention, in order to enhance adhesivity to paper, it is preferable that the ester concentration to be defined by the formula (1) in the crystalline polyester resin to be used as the binder resin is held in a range of from 0.01 to 0.2.

In the fusing apparatus of the belt-nip system to be used in the invention, pressure to be applied to the toner image at the time of fusing can be lowered. When the pressure to be applied to the toner image is low, there, ordinarily, is generated a problem of sticking of the toner image to paper, that is, a problem of stability of the fused image. However, since the ester concentration of the toner to be used in the invention is held in de above-described range, the adhesivity to the paper becomes favorable so as to advantageously solve the problem of stability of the fused image.

Method of Producing Crystalline Polyester Resin

A method of producing crystalline polyester resin is not limited in any particular way. The crystalline polyester resin can be produced by using an ordinary polymerization method which reacts an acid component with an alcohol component; on this occasion, for example, each of a dire polycondensation method, and a transesterification method is appropriately used in accordance with a type of a monomer. A molar ratio (acid component/alcohol component) in which the acid component and alcohol component are reacted with each other depends on reaction conditions and other conditions so that the molar ratio is not defined in a general way, however, it is ordinarily about 1/1.

Production of the polyester resin can be performed at a polymerization temperature in a range of from 180° C. to 230° C. and, optionally, under a reduced pressure while removing water or alcohol which will be generated at the time of condensation.

When a monomer is not dissolved or immiscible, a high boiling solvent may be added as a dissolving auxiliary to dissolve the monomer. A polycondensation reaction is performed while the solvent as the dissolving auxiliary is being removed by vaporization. In a case in which an immiscible monomer is present in the copolymerization reaction, such immiscible monomer may previously be condensed with an acid or alcohol with which the monomer is intended to be polycondensed and, thereafter, polycondensed together with a principal component.

Examples of catalysts which can be used at the time of producing the polyester resin include compounds of alkali metals such as sodia and lithium, compounds of alkali earth metals such as magnesium, and calcium, compounds of metals such as zinc, manganese, antimony, titanium, tin, zirconium, and germamum, phosphorous acid compounds, phosphoric acid compounds, and amine compounds. Specifically, mentioned are following compounds: for example, sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octoate, germanium oxide, triphenyl phosphite, tris(2,4-di-t-butylphenyl)phosphite, ethyltriphenyl phosphonium bromide, triethylarnine, and triphenylamine.

2. Colorant

Colorants to be used in the present invention are not limited to any type but known colorants are permissible. They can appropriately be selected in accordance with intended purposes. The colorants may be used singly, or two or more colorants of the same series may be mixed and used. Two or more colorants of different series may also be mixed and used. Specifically, examples of the colorants include various types of carbon black such as furnace black, channel black, acetylene black, and thermal black, inorganic pigments such as red iron oxide, aniline black, iron blue, titanium oxide, and magnetic powders, azo pigments such as fast yellow, monoazo yellow, disazo yellow, pyrazolone red, chelate red, brilliant carmine (for example, 3B, and 6B), and Para Brown, phthalocyanine pigments such as copper phthalocyanine, non-metallic phthalocyanine and the like and melted polycyclic pigments such as flavanthrone yellow, dibromoanthrone orange, perylene red, quinacridone red, and dioxazine violet.

Further, examples of other pigments and dyes include various types of pigments such as Chrome Yellow, Hanza Yellow, Benzidine Yellow, Threne Yellow, Quinoline Yellow, Permanent Orange GCR, Pyrazolona Orange, Vulcan Orange, Watchung Red, Peranent Red, DuPont Oil Red, lithol Red, Rhodamine B Lake, Lake Red C, Rose Bengal, Aniline Blue, Ultramarine Blue, Chalcone Oil Blue, Methylene Blue Chloride, Phthalocyanine Blue, Phthalocyanine Green, Malachite Green Oxalate, and Para Brown and dyes of various series such as an acridine series, a xanthene series, an azo series, a benzoquinone series, an azine series, an anthraquinone series, a dioxazine series, a thiazine series, an azomethine series, an indigo series, a thioindigo series, a phthalocyanine series, an aniline black series, a polymethine series, a tiphenylmethane series, a diphenylmethane series, and a thiazole series. A black pigment or a black dye, such as carbon black, may be added to the colorant so far as transparency thereof is not lowered. Further, a disperse dye, and an oil-soluble dye can also be used.

A content of the colorant in the toner is preferably from 1 mass part to 20 mass parts based on 100 mass parts of the binder resin; however, it is advisable that the content is as high as possible so long as smoothness of the surface of the fused image is not impaired. When the content of the colorant is increased, thickness of the image can be decreased in obtaining the image of a same density. The thus-decreased thickness is advantageously effective in preventing the hot offset.

Further, by selecting an appropriate color from among the above-described colorants, any one of a yellow toner, a magenta toner, a cyan toner, and a black toner can be obtained.

3. Other Components

In the toner to be used in the present invention, known additives can optionally be used as other components than the above-described essential components in accordance with intended purposes. Various types of the known additives such as inorganic fine particles, organic fine particles, an electrostatic suppressant, and a release agent are mentioned.

The inorganic fine particles are ordinarily used to improve flowability of the toner. As for the inorganic fine particles, known inorganic fine particles such as silica fine particles, titanium oxide fine particles, alumina fine particles, cerium oxide fine particles, a product prepared by treating a source of the fine particles and other fine particles can be used singly or two or more types of inorganic fine particles may be mixed and used; however, on this occasion, silica fine particles having a refractive index smaller than that of the binder resin is preferable from the standpoint of not impairing a color forming property or transparency such as OHP transmittance. Further, the silica fine particles may be subjected to various types of surface treatments; on this occasion, it is preferable that they are subjected to surface treatments by, for example, a silane coupling agent, a titanium coupling agent, and silicone oil.

By internally adding these inorganic fine particles into the toner, viscoelacity thereof can be controlled whereupon image gloss and permeation of the toner into a sheet can be controlled. A content of the inorganic fine particles is preferably from 0.5% by mass to 15% by mass and, more preferably, from 1% by mass to 10% by mass.

The organic fine particles are ordinarily used for improving cleanabiity or transferability. Examples of the organic fine particles include fine particles of polystyrene, polymethyl methacrylate, and polyvinylidene fluoride.

The electrostatic suppressant is ordinarily used for improving a charge property. Examples of electrostatic suppressants include metal-containing azo compounds such as chrome type azo dye, iron type azo dye, aluminum azo dye, a metal complex salicylate, a metal salicylate, nigroine, and a quaternary ammonium salt.

The release agent is ordinarily used for improving releasability. Examples of release agents include low molecular polyolefins such as low molecular polyethylene, low molecular polypropylene, and low molecular polybutene, a silicones having a softening point by heating, fatty-acid amides such as oleic acid amide, erucic acid amide, ricinoleic acid amide, and stearic acid amide, vegetable waxes such as carnauba was, rice wax, candelilla wax, Japan wax, and jojoba oil, animal waxes such as beeswax, mineral and petroleum waxes such as montan wax, ozokerite, ceresine, paraffin wax, microcrystalline wax, and Fischer-Tropsch wax, aliphatic esters, montanic acid esters, and carboxylic acid ester type waxes. In the invention, these waxes may be used singly or two or more waxes thereof may be mixed and used.

A quantity of these release agents is preferably from 1% by mass to 20% by mass, more preferably, from 2% by mass to 18% by mass and, most preferably, from 5% by mass to 15% by mass. When the quantity is less than 1% by mass, there is no effect of addition of any one of these release agents whereas, when the quantity is more than 20% by mass, a detrimental effect is apt to be given to the charge property and the toner is apt to be broken in the developing apparatus to allow the release agent to turn into a spent state and stick on the carrier whereupon a detrimental effect is apt to be given to a charge property and, further, for example, when a color toner is used, permeation thereof into the surface of the image is apt to be insufficient whereupon the release agent is apt to rein within the image thereby disadvantageously deteriorating transparency of the image.

Further, a melting point of the release agent to be used is preferably from 50° C. to 100° C. and, more preferably, from 60° C. to 100° C. When the melting point is higher than the above described range, a detrimental effect is given to flowability and storage stability in an atmosphere of high temperature of toner powders and there is a fear that the charge property thereof is deteriorated, whereas, when the melting point is lower than the above described range, the release agent is not melted at the time of low temperature fusing so that it is considered that the release agent can not be expected to sufficiently contribute to releasability from a fixation roll.

Preferable Physical Property of Toner

While the toner to be used in the present invention has been described above in detail, it is preferable that the toner has characteristics as described below.

The toner to be used in the present invention is a toner in which a storage elastic modulus $G_L(90)$ and a loss elastic modulus $G_N(90)$ at an angular frequency of 1 rad/s and 90° C. and the storage elastic modulus $G_L(120)$ and the loss elastic modulus $G_N(120)$ at an angular frequency of 1 rad/s and 120° C. are all $1\times10^5$ Pa or less and the toner satisfies the following formula (1):

$$\log G_L(90)-\log G_L(120)<2 \quad (1)$$

The storage elastic modulus $G_L$ and the loss elastic modulus $G_N$ are measured using a rotary rheometer with plates (RDA 2RHIOS System ver. 4.3.2, available from Rheometric Scientific F.E.Ltd.). Such a measurement as described above is, for example, conducted by setting a sample in a sample holder under conditions that a rate of temperature rise is 1° C./min, a frequency is 1 rad/s, a strain is 20% or less and a detection torque is within a measurement proof value. A size of the sample holder is adjusted to either 8 mm or 20 mm, as required.

So long as the storage elastic modulus $G_L(90)$ is $1\times10^5$ Pa or less, it is possible to perform fixation at a temperature as low as close to 100° C. Further, a relation expressed by the formula shows that a viscosity change against a temperature change after the toner is melted is small; such a situation as described above means that, even when a fusing temperature is not uniform in the entire fusing apparatus, uneven fusion or uneven gloss is unlikely to occur in the image after subjected to fusing. These situations are effective in preventing an excessive permeation of the toner into the sheet or generation of the hot offset.

Further, it is preferable that, in order to improve offset resistance, the toner to be used in the invention has a melt viscosity of 100 Pa·S or more at 120° C.

Furthermore, it is preferable that the toner to be used in the invention has a sufficient hardness at room temperature. Specifically, with respect to a dynamic viscoelasticity, it is desirable that at an angular frequency of 1 rad/sec and 30° C., the storage elastic modulus $G_L(30)$ is $1\times10^6$ Pa or more and the loss elastic modulus $G_N(30)$ is $1\times10^6$ Pa or more. Details of the storage elastic modulus $G_L$ and the loss elastic modulus $G_N$ am defined by JIS K6900.

In a case in which at an angular frequency of 1 rad/sec and 30° C., the storage elastic modulus $G_L(30)$ is less than $1\times10^6$ Pa and the loss elastic modulus $G_N(30)$ is less than $1\times10^6$ Pa, the toner particles are deformed by a pressure or a shearing force given from a carrier when mixed with a carrier in a developing apparatus, making it impossible to maintain stable charge-developing characteristics. Further, when the toner on the latent image holding member (photoreceptor) is cleaned, it is deformed by a shearing force given by a cleaning blade whereupon insufficient cleaning occurs.

In a case in which, at an angular frequency of 1 rad/sec and 30° C., the storage elastic modulus $G_L(30)$ and the loss elastic modulus $G_N(30)$ are within the above-described range, it is preferable that the characteristics on fusing are stable even when the toner is used in a high-speed machine.

Furthermore, it is preferable that the toner to be used in the invention has an area of temperature in which fluctuations of the above-described values that are brought about by temperature changes are 1000 or more in a temperature range of 10°C. (that is, the area of temperature in which, when a temperature is raised by 10° C., values of $G_L$ and $G_N$ are changed by a value of down to one thousandth or less the original value). Unless the storage elastic modulus $G_L$ and the loss elastic modulus $G_N$ have an above-described area of temperature, the fusing temperature goes up and, as a result, reduction of energy consumption in a fusing step sometimes becomes insufficient.

FIG. 1 is a graph showing preferable characteristics of a toner to be used in the present invention. In FIG. 1, an axis of ordinates shows a common logarithm $\log G_L$ of a storage elastic modulus or a common logarithm $\log G_N$ of a loss elastic modulus while an axis of abscissas shows a temperature. Thus, in the toner of the invention having such characteristics as shown in FIG. 1, a sharp decrease of the elastic modulus is observed at the melting point in a temperature region of from 50° C. to 120° C., and, then, the elastic modulus becomes stable in a predetermined range.

Therefore, even when the temperature is high on fusing, the viscosity is not decreased more than as required, and an excessive penetration in a material for transfer such as a sheet can be prevented. Further, even when a fusing temperature is not uniform in the entire fusing apparatus, uneven fusion or uneven gloss is unlikely to occur in the image thereby being capable of forming a favorable image.

It is preferable that the toner to be used in the invention has a melting point in a temperature region of from 50° C. to 120° C. The crystalline resin sharply decreases a viscosity thereof outside the melting point. Therefore, when the toner is stored above this melting point, agglomeration and blocking thereof occur. Thus, it is preferable that the melting point of the toner which has the binder resin as the principal component is a temperature to which it is exposed during storage or in use, namely, 50° C. or more. while, when the melting point is higher than 120° C., there is a case in which the low-temperature fusing cannot be achieved. It is more preferable that the toner to be used in the invention has the melting point in a temperature region of from 60° C. to 110° C.

The melting point of the toner can be measured as a melting peak temperature by the input-compensated differential scanning calorimetry defined by JIS K-7121. Further, since the toner has a crystalline resin which sometimes shows plural melting peaks as a principal component, the toner sometimes shows plural melting peaks; however, in the invention, a maximum peak is defined as the melting point A volume-average particle size of the toner to be used in the invention is preferably from 1 μm to 12 μm and, more preferably, from 3 μm to 8 μm. A number-average particle size is preferably from 1 μm to 10 μm and, more preferably, from 2 μm to 8 μm. A value obtained by dividing the volume-average particle size by the number-average particle size (volume-average particle size/number-average particle size) which is an indication of a particle size distribution is preferably 1.6 or less and, more preferably, 1.5 or less. When this value is larger than 1.6, the particle size distribution becomes larger and, accordingly, a charge distribution becomes larger to sometimes generate a reversed-polar toner or a low-charged toner.

The volume-average particle size and number-average particle size can be measured by, for example, a Coulter counter TA-II type (available from Beckman Coulter, Inc.) at an aperture diameter of 50 μm. On this occasion, such a measurement as described above is performed after the toner is dispersed in an electrolyte (isoton aqueous solution) and the thus-prepared dispersion is further dispersed by means of ultrasonic wave for 30 seconds or more.

Since the toner to be used in the invention is constituted as described above, it is excellent in an anti-toner-blocking property, storage stability and a low-temperature fusing property of the image.

Method of Producing Toner

A method of producing the toner to be used in the present invention is not limited in a particular way and a wet type granulation method is preferable. As for the wet type granulation method, known methods such as a melt-suspension method, a emulsify-agglomeration method, and a dissolve-suspension method are favorably used. As an example of the emulsify-agglomeration method, a case in which a crystalline polyester resin is used as a principal component of a binder resin is described below.

The emulsify-agglomeration method includes an emulsifying step in which the crystalline polyester resin that has been described in the foregoing item 1 "Binder resin" is emulsified to form emulsified particles (droplets), an agglomerating step in which an agglomerated body of the thus-formed emulsified particles (droplets) is formed and acoalescence step in which the thus-formed agglomerated body is heat-melted.

Emulsifying Step

In the emulsifying step, the emulsified particles (droplets) of the crystalline polyester resin are formed by applying a shearing force to a solution which is prepared by mixing an aqueous medium and a mixture (polymer liquid) containing a crystalline polyester resin which has been subjected to a sulfonation reaction or other reactions and, optionally, a colorant. On this occasion, it is possible to form the emulsified particles by decreasing a viscosity of the polymer liquid by means of heating or dissolving the crystalline polyester resin in an organic solvent. Further, in order to improve stability of the emulsified particles or increase the viscosity of the aqueous medium, a dispersant may also be used. Hereinafter, a dispersion liquid of the emulsified particles prepared by using the dispersant as described above is also referred to as "resin particle dispersion liquid".

Examples of such dispersants as described above include water-soluble polymers such as polyvinyl alcohol, methyl cellulose, ethyl cellulose, hydroxyethyl cellulose, caboxymethyl cellulose, sodium polyacrylate, and sodium polymethacrylate surfactants including anionic surfactants such as sodium dodecylbenzeee sulfonate, sodium octadecyl sulfate, sodium oleate, sodium laurate, and potassium stearate, cationic surfactants such as laurylaine acetate, stearylamine acetate, and lauryl trimethyl ammonium chloride, amphoteric ionic surfactants such as lauryl dimethylamine oxide, nonionic surfactants such as polyoxyethylene alkyl ether, polyoxyethylene alkyl phenyl ether, and polyoxyethylene alkylamine, inorganic compounds such as calcium tertiary phosphate, aluminum hydroxide, calcium sulfate, calcium carbonate, and barium carbonate.

When an inorganic compound is used as the dispersant, a commercially available compound may be used as it is or the inorganic compound may be formed in fine particles by a method of producing fine particles of the inorganic compound in the dispersant and then used.

A quantity of the dispersant is preferably from 0.01 mass part to 20 mass parts based on 100 mass parts of the crystalline polyester resin (binder resin).

Further, in the emulsifying step, by previously copolymerizing the crystalline polyester resin with a dicarboxylic acid having a sulfonic acid group (that is, allowing an appropriate quantity of a constituent component derived from a dicarboxylic acid having a sulfonic acid group to be contained in a constituent component derived from an acid), a content of a dispersion-stabilizer such as a surfactant can be reduced or, in some cases, emulsified particles can be formed without using the dispersion-stabilizer.

Examples of such organic solvents as described above include ethyl acetate, and toluene and an appropriate solvent is selected from there among in accordance with the crystalline polyester resin.

A quantity of the organic solvent to be used is preferably from 50 mass parts to 5000 mass parts and, more preferably, from 120 mass parts to 1000 mass parts based on 100 mass parts, that is, a total quantity, of the crystalline polyester resin and optionally-added other monomers (hereinafter, also referred to as "polymer" altogether). Further, before the emulsified particles are formed, a colorant may be incorporated thereto. Colorants to be used on this occasion are same as those described in item 2. "Colorant" of the electrophotographic toner of the present invention.

Examples of emulsifying devices to be used for forming the emulsified particles include a homogenizer, a homomixer, a pressure kneader, an extruder, and a media dispersing device. A size of the emulsified particles (droplets) of the crystalline polyester resin is, as an average particle size (volume-average particle size), preferably from 0.01 μm to 1 μm, more preferably from 0.03 μm to 0.3 μm and most preferably from 0.03 μm to 0.4 μm.

A dispersion method of the colorants is not limited in any particular way and given methods, that is, ordinary dispersion methods such as a rotatable shearing type homogenizer, a ball mill having a medium, the sand mill, Dyno mill and the like can be Optionally, it is possible that an aqueous dispersion liquid of these colorants is prepared by using a surfactant or an organic solvent dispersion liquid of these colorants is prepared by using a dispersant. Hereinafter, such dispersion liquids as described above are sometimes referred to as "colorant particle dispersion liquid". As for the surfactant and dispersant to be used for dispersion, a same dispersant as that capable of being used for dispersing the crystalline polyester resin can be used.

When the colorant is mixed in the emulsifying step, mixing of the polymer and the colorant can be performed by mixing the organic solvent solution of the polymer with either to the colorant or the organic solvent dispersion liquid of the colorant.

Agglomerating Step

In the agglomerating step, the thus-obtained emulsified particles are heated at a temperature in the neighborhood of, though lower than, a melting point of the crystalline polyester resin whereby they are agglomerated to form an agglomerated body.

Such forming of the agglomerated body of the emulsified particles as described above is performed while stirring under a condition that a pH of an emulsified liquid is acidic. The pH is preferably from 2 to 6, more preferably from 2.5 to 5 and most preferably from 2.5 to 4. On this occasion, it is effective to further use an agglomerating agent.

As for the agglomerating agent to be used, a surfactant having an polarity reverse to that of the surfactant to be used as the dispersant, an inorganic metallic salt and a metallic complex having 2 valences or more are advantageously used. Particularly, when the metallic complex is used, a quantity of the surfactant to be used can be decreased; such a case as described above is particularly preferable from the standpoint of improving charge characteristics.

Examples of the metallic complexes include metallic salts such as calcium chloride, calcium nitrate, barium chloride, magnesium chloride, zinc chloride, aluminum chloride, and aluminum sulfate, inorganic metallic polymers such as polyaluminum chloride, polyaluminum hydroxide, and polycalcium sulfide. Among other things, particularly, aluminum salts and a polymer thereof are favorably used. In order to obtain a sharper particle distribution, a compound having a higher valence is more advantageous than that having a lower valence; in other words, a compound having 2 valences is more advantageous than a compound having monovalence and, as in a same manner, a compound having 3 valences than a compound having 2 valences and a compound having 4 valences than a compound having 3 valences. Further, in a case in which a compound has a same valence, the compound of a polymer-type inorganic metallic salt is favorable.

Coalescence Step

In the coalescence step, while continuing stirring in a same manner as in the agglomerating step, a progress of the agglomeration is stopped by allowing a pH of a suspension liquid of the agglomerated body to be in a range of from 3 to 4 and, then, the suspension liquid is heated at a temperature higher than the melting point of the crystalline polyester resin to melt the agglomerated body.

There is no problem so long as such a heating temperature as described above is higher than the melting point of the crystalline polyester resin.

A time period to be used for heating is not particularly limited so long as such a coalescence as described above is sufficiently executed and the time period of from 0.5 to 10 hours is permissible.

Melted particles thus obtained by the coalescence step are passed through a solid-liquid separating step such as filtering and, optionally, a washing step and a drying step to form toner particles. On this occasion, in order to secure sufficient charge characteristics and reliability as a toner, it is preferable to sufficiently perform washing in the washing step.

In the drying step, given methods such as an ordinary vibration-type fluid drying method, a spray drying method, a freeze-dry method, and a flash jet spraying method can be applied. A water content of the toner particles after dried is controlled to be preferably 1.0% or less and more preferably 0.5% or less.

In the coalescence step, while the crystalline polyester resin is heated at a temperature higher than the melting point thereof or after the coalescence is terminated, a crosslinking reaction is allowed to be performed. Alternatively, the crosslinking reaction is allowed to be performed simultaneously with the agglomeration. When the crosslinking is performed, for example, an unsaturated sulfonated crystalline polyester resin which has been copolymerized with a component having a double bond is used as a binder resin, a radical reaction is allowed to occur in this resin and a crosslink structure is provided to the resin. On this occasion, a polymerization initiator as described below is used.

Examples of such polymerization initiators as described above include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butyl cumyl peroxide, dicumyl peroxide, 2,2'-azobisisobutyronitrile, 2,2'-azobis(2-methyl butyronitrile), 2,2'-azobis(2,4-dimethyl valeronitrile), 2,2'-azobis(4-methoxy-2,4-dimethyl valeronitiile), 1,1-bis(t-butyl peroxy) 3,3,5-trimethyl cyclohexane, 1,1-bis(t-butyl peroxy) cyclohexane, 1,4-bis(t-butyl peroxycarbonyl)cyclohexane, 2,2-bis(t-butyl peroxy)octane, n-butyl 4,4-bis(t-butyl peroxy)valerate, 2,2-bis(t-butyl peroxy)butane,1,3-bis(t-butyl peroxyisopropyl)benzene, 2,5-dimethyl-2,5-di(t-butyl peroxy)hexane, 2,5-dimethyl-2,5-di(benzoyl peroxy) hexane, di-t-butyl diperoxyisophthalate, 2,2-bis(4,4-di-t-butyl peroxycyclohexyl)propane, di-t-butyl peroxyα-methyl succinate, di-t-butyl peroxydimethyl glutarate, di-t-butyl peroxyhexahydroterephthalate, di-butyl peroxyazelate, 2,5-dimethyl-2,5-di(t-butyl peroxy)hexane, diethylene glycol-bis(t-butyl peroxycarbonate), di-t-butyl peroxytrimethyl adipate, tris(t-butyl peroxy)triazine, vinyl tris(t-butyl peroxy)silane, 2,2'-azobis(2-methyl propionamidin dihydrochloride), 2,2'-azobis[N-(2-boxyethyl)-2-methyl propionamidin], and 4,4'-azobis(4-cyanovaleric acid).

These polymeization initiators can be used singly or two or more types thereof in combination A quantity or a type of the polymerization initiator is appropriately selected depending on a position of an unsaturated portion in a polymer or a type or quantity of a colorant which exists therewith.

The polymerization initiator may be mixed with the polymer before proceeding to the emulsifying step, incorporated into an agglomerated block in the agglomerating step. Alternatively, introduction of the polymerization initiator may be performed in the coalescence step or in a stage after the coalescence step. When the polymenzation initiator is introduced in the agglomerating step, the melting step or in the stage after the coalescence step, a liquid in which the polymerization initiator is dissolved or emulsified is added to a particle-emulsified liquid (for example, resin particle-emulsified liquid). In any cases described above, the polymerization initiator may be added with a known compound such as a crosslinking agent, a chain transfer agent, and the polymerization inhibitor, in order to control a degree of polymerization.

According to the method (emulsify-agglomerating method) of producing the toner to be used in the invention as described above, a particle shape and particle size of the toner can be adjusted or controlled. It is preferable that the particle shape of the toner is spherical. By allowing the particle shape of the toner to be spherical, a non-electrostatic sticking force thereof is decreased whereupon it becomes possible that enhancement of transfer efficiency of the toner is intended and, on this occasion, powder flowability can also be enhanced.

As for the toner according to the invention, an external additive such as a fluidizing agent, and an auxiliary may be added to a surface of the toner particles to treat the surface thereof. As for external additives, known fine particles such as those of inorganic compounds, for example, silica, titanium oxide, alumina and cesium oxide, surfaces of which has been subjected to a hydrophobic treatment, and carbon black, those of polymers, for example, a polycarbonate, polymethylmethacrylate, and a silicone resin can be used. It is preferable that at least two types thereof are used as external additives; on this occasion, an average primary particle size of at least one type of the two types of the external additives is preferably from 30 nm to 200 nm and more preferably from 30 nm to 150 nm.

When the average primary particle size is less than 30 nm, the non-electrostatic sticking force thereof to a photoreceptor is increased to cause a transfer defect or a drop-off image called as a hollow character whereupon a transfer unevenness of overlapped images will sometimes occur, on this occasion, there is a case in which, though initial fluidity of the toner is favorable, the non-electrostatic sticking force between the toner and the photoreceptor is not sufficiently reduced whereupon transfer efficiency is lowered to cause a drop-off phenomenon in the image or to deteriorate uniformity of the image sometimes. Further, fine particles are imbedded in the surface of the toner by mechanical stress in the developing apparatus along the passage of time whereby the charge is changed and, then, a problem such as a decrease of copy density, or a fog to a background portion is generated in some cases. On the other band, when the average primary particle size is more than 200 nm, the external additive tends to be separated from the surface of the toner to deteriorate the flowability thereof in some cases.

While, perfuming the steps as described above, the toner to be used in the invention is produced, the toner may have a constitution that the surface thereof is further coated with a surface layer.

It is preferable that the surface layer does not give a substantial effect to kinetic characteristics and melt viscoelasticity characteristics of the entire toner. For example, when the toner is coated thick with the surface layer which is not melted or has a high melting point, an intended low temperature fusing property obtained by using the crystalline polyester resin can not be sufficiently executed.

Therefore, it is preferable that the surface layer is thin; specifically, it is preferable that thickness thereof is within a range of from 0.001 $\mu$m to 0.5 $\mu$m.

In order to form a thin surface layer having the above-described range of thickness, a method in which the surface of the particle which contains a binder resin, a colorant and, optionally, an inorganic fine particle and other materials is chemically treated is advantageously used.

Examples of components constituting the surface layer include a silane coupling agent, isocyanates, and a vinyl monomer. It is preferable that a polar group is introduced into the above-described components; on this occasion, by chemically bonding the polar group therewith, adhesivity between the toner and a transfer material such as a sheet is enhanced.

As for the polar group, any polar group is permissible so long as it is of a polarized functional group. Examples of the polar groups include a carboxyl group, a carbonyl group, an epoxy group, an ether group, a hydroxyl group, an amino group, an imino group, a cyano group, an amide group, an ester group, a sulfonic group and the like.

Examples of such chemically treating methods as described above include a method of performing oxidization by a strong oxidizing substance such as a peroxide, another method of performing oxidization by ozone, and plasma, and another method of combining a polymerizable monomer containing a polar group by a graft polymerization. By performing a chemical treatment, the polar pup is firmly bonded to a molecular chain of the crystalline resin through covalent bonding. A substance having a charge property may further be adhered either chemically or physically to the surface of the toner to be used in the invention. Further, for the purpose of improving the charge property, an electroconductive property, powder flowability, lubricity and other properties, fine particles of metal a metal oxide, a metallic salt, ceramic, a resin, carbon black may be added externally.

Carrier

The toner constitutes a two-component developer together with a carrier which is described below.

It is preferable that the developer to be used in the invention is of a two-component developer which is excellent in a maintaining property or stability of electrostatic charge. The carrier is, preferably, of a type coated with a resin and, more preferably, of a type coated with a nitrogen-containing resin.

Examples of such nitrogen-containing resins as described above include acrylic resins such as dimethylamino ethyl methacrylate, dimethyl acrylamide, and acrylonitrile, amino resins such as urea, urethane, melamine, guanamine, and aniline, an amide resin, and a urethane resin. Further, resins copolymerized with any one of these resins are permissible.

As for a coating resin for carrier, two or more types from among the above-described nitrogen-containing resins may be mixed and used. Further, a combination of at least one of the above-described nitrogen-containing resins and a nitrogen-non-containing resin may be used. Furthermore, at least one of the above-described nitrogen-containing resins is first formed in fine particles and, then, the thus-formed fine particles thereof may be dispersed in the nitrogen-non-containing resin and used. Particularly, since a urea resin, the urethane resin, a melamine resin and the amide resin are high in a negative charge property and, further, high in resin harness, decrease of electrostatic charge quantity to be caused by peeling-off of the coating resin can be controlled; hence, these resins are favorable.

Ordinarily, it is preferable that the carrier has an appropriate electric resistance; specifically, it is preferable that the carrier has the electric resistance of from about $10^9$ Ωcm to about $10^{14}$ Ωcm. When the electric resistance is as low as $10^6$ Ωcm, for example, as with the carrier of iron powders, a problem that carrier is adhered to an image portion of a photoreceptor (latent image holding member) by charge injection from a sleeve or a latent image charge is leaked through the carrier to cause a distorted latent image or a defective image or the like is sometimes generated. On the other hand, when an insulating resin is applied thick, the electric resistance becomes excessively high, a carrier charge becomes to be hardly leaked and, as a result, while the image having a sharp edge portion is produced, a problem of an edge effect that an image density in a central part of the image having a large surface area is excessively lowered is sometimes generated. Therefore, in order to adjust the resistance of the carrier, it is preferable that electroconductive fine particles are dispersed in a resin coating layer.

Examples of the electroconductive fine particles include, specifically, metals such as gold, silver, and copper, carbon black, semi-electroconductive oxides such as titanium oxide, and zinc oxide, powders of titanium oxide, zinc oxide, barium sulfate, aluminum borate, and calcium titanate surfaces of all of which have been coated with tin oxide, carbon black or a metal. Among them, carbon black is favorable from the standpoint of production stability, cost and advangateous electroconductivity.

Examples of methods of forming the above-described resin coating layer on a surface of a carrier core material includes an immersion method of immersing powders of the carrier core material in a solution for forming a coating layer, a spray method of spraying the solution for forming the coating layer on a surface of the carrier core material, a fluidized bed method of praying the solution for forming the coating layer while the carrier core material is floated by a flowing air, a kneader-coater method of first mixing the carrier core material and the solution for forming the coating layer in a kneader-coater and, then, removing the solvent therefrom, a powder-coating method of first mixing a coating resin which has been formed in fine particles at a temperature of a melting point or more of the coating resin and the carrier core material, then, cooling the resultant mixture and, thereafter, coating the thus-cooled mixture; among other things, the kneader-coater method and the powder-coating method are particularly favorably used.

An average thickness of the resin coating layer to be formed by the above-described methods is ordinarily from 0.1 μm to 10 μm and preferably from 0.2 μm to 5 μm.

A core material to be used in the carrier for developing the electrostatic latent image is not particularly limited and magnetic metals such as iron, steel, nickel and cobalt, magnetic oxides such as a ferrite and magnetite, and glass beads are used; among other things, from the standpoint that a magnetic brush is used, a magnetic carrier is desirable. On this occasion, ordinarily, an average particle size of the carrier core material is preferably from 10 μm to 100 μm and more preferably from 20 μm to 80 μm.

A mixing ratio of the toner to the carrier in the two-component developer is preferably approximately from 1:100 to 30:100 and more preferably approximately from 3:100 to 20:100.

Transfer Step

The transfer step according to the invention is a step in which the toner image formed on the latent image holding member is transferred on to the transfer material such as a sheet to form the transferred image; the step is ordinarily performed by utilizing an electrostatic attraction force. On this occasion, while the toner image obtained by the developing step can be transferred on to the transfer material as it is, it is also possible to adopt a system that, by adopting an intermediate transfer material, the toner image is first transferred to the intermediate transfer material and then transferred from the intermediate transfer material to the transfer material.

When it is intended to obtain a full-color image, toner images developed by using toners of at least three colors of cyan, magenta and yellow and, optionally, of four colors adding black thereto are transferred while being overlapped with one another. On this occasion, by using the intermediate transfer material the toner images are once transferred on to the intermediate transfer material while being overlapped within another and the thus-once-transferred toner images are then transferred on to the transfer material at a time. Such procedures as described above are favorable, since the image which is in registry with a transfer position and has a satisfactorily formed color can be obtained.

When it is intended to obtain a single-color image, a toner mass (TMA) of the image in a region of an image area ratio 100% of the transferred image transferred on the transfer material in the transferring step is preferably 0.80 mg/cm$^2$ or less and more preferably 0.60 mg/cm$^2$ or less.

Fusing Step

The fusing step according to the present invention is a step of fusing the toner image transferred on the transfer material. As for a fusing apparatus for fusing the transferred image to be used in the invention, the fusing apparatus of a belt-nip system is used. This fusing apparatus is constituted by a heat-fixing roll and an endless belt to form a nip and, then, the transfer material on which the toner image is formed is allowed to pass through the thus-formed nip to fix the toner image.

Fusing Apparatus

Figure 2:
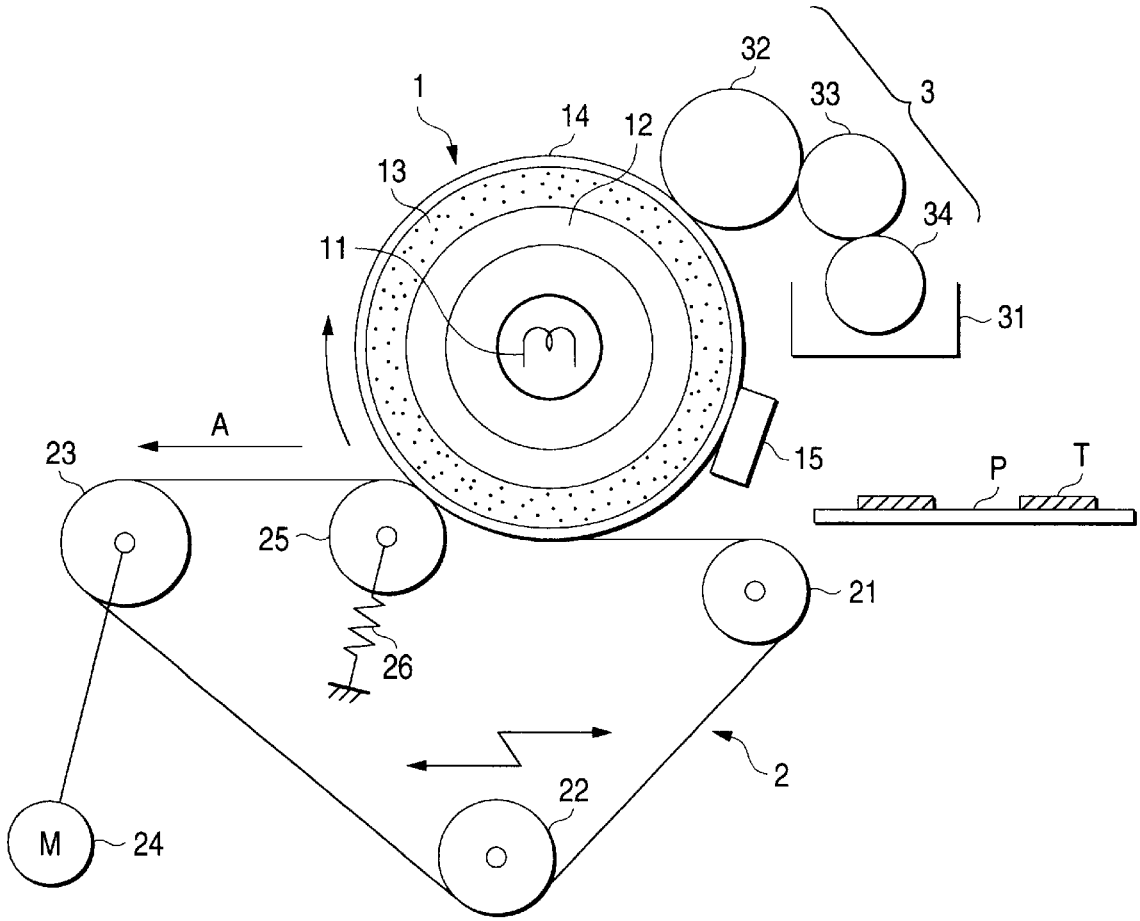
FIG. 2 is a schematic cross-sectional view of a construction of a fixing apparatus as an illustrative embodiment.

The fusing apparatus to be used in the image forming method according to the present invention is now described in detail below with reference to FIG 2. FIG. 2 is a cross-sectional view for explaining a configuration of the fusing apparatus according to the invention as an illustrative embodiment but not limiting it in any way. As shown in FIG. 2, the fusing apparatus has a beat-fixing roll 1, plural support rolls 21, 22 and 23 and an endless belt (beat resistant belt) 2 tightly stretched thereamong. Further, the fusing apparatus according to the invention may have a constitution in which it is provided with another endless belt to encircle the beat-fixing roll 1 which will then form a nip between the endless belt 2 by way of the thus-provided another endless belt.

The heat-fixing roll 1 has a constitution in which a hollow roll 12 made of metal containing a halogen lamp as a heat source is covered by an underlying layer (heat resistant elastic body layer) 13 of 0.5 mm or more thick made of a heat resistant elastic body and, further, a top coat 14 on top of the thus-formed underlying layer 13. A surface temperature of the heat-fixing roll 1 is monitored by a temperature sensor 15 such that it can be controlled to be at a predetermined temperature. The thickness of the underlying layer (heat resistant elastic body layer) 13 is preferably 0.5 mm or more and more preferably 1 mm or more.

The endless belt 2 is wound around the heat-fixing roll 1 by a predetermined angle such that the nip is formed between the above-described endless belt 2 and the heat-fixing roll 1. This angle is ordinarily from 10°to 65°, preferably from 20° to 60° and more preferably from 30° to 50°.

Since the support roll 23, that is, one of the support rolls 21, 22 and 23 among them the endless belt is stretched is connected with a motor 24, the support roll 23 can be rotated. For this reason, the support roll 23 functions as a driving roll whereby it can rotate the endless belt 2 in a direction which an arrow mark A shows. Therefore, the heat-fixing roll 1 which is positioned in contact with the endless belt 2 is rotated in a driven manner in a direction which the arrow mark A shows.

In the present fusing apparatus, a pressure roll 25 is further provided inside the endless belt 2 at an exit of the nip. The above-described pressure roll 25 is press-contacted with the heat-fixing roll 1 via the endless belt 2 by means of a helical compression spring 26. By such an arrangement as described above, the pressure roll 25 can generate a strain on the heat resistant elastic body layer of the heat-fixing roll 1. Since the pressure roll 25 allows the strain to be efficiently generated on the heat-fixing roll 1 with a low load, it can have a smaller diameter than that of the heat-fixing roll 1; on this occasion, it is preferable that a surface of the pressure roll 25 is hard.

In the present fusing apparatus, it is preferable that stain quantity $\epsilon$ in a circumferential direction to be generated on the heat resistant elastic body layer constituting the heat-fixing roll 1 by press-contacting the pressure roll 25 satisfies the following relational expression:

$$\epsilon \geqq 0.5\%$$

The strain quantity $\epsilon$ can be determined by a method described below.

When the pressure roll 25 and the heat-fixing roll 1 are press-contacted under load, the surface of the heat-fixing roll 1 is subjected to an elastic deformation to generate a strain on the surface in a circumferential direction. While the heat-fixing roll 1 is rotated under these arrangements, when a sheet P is passed through a nip region, the sheet P is transported in the nip region in which the strain is present. For this reason, a length of the sheet P which is discharged by a rotation of the heat-fixing roll 1 having the strain thereon is larger than a circumferential length of the heat-fixing roll 1 by a length of the strain in the circumferential direction. Therefore, the strain quantity $\epsilon$ can be determined by the following expression:

Strain quantity $\epsilon$=(length of recording paper to be discharged by one rotation of elastic body roll)/(circumference of elastic body roll when $\epsilon$=0)−1

So long as the strain quantity $\epsilon$ satisfies the above-described relational expression, an effect to decrease adherence of a melted toner to the surface of the fixing roll at the exit of the nip can be obtained whereby a self-stripping property and hot offset resistance are improved.

In the fusing apparatus, a release agent applicator 3 may be provided which is effective in promoting releasability of the transfer material. The release agent applicator 3 has a vessel 31 for containing a release agent and three rolls 32, 33 and 34 which are contacted with one another. The roll 32, one of them, is arranged to contact the heat-fixing roll 1 while the roll 34, another roll of them, is arranged to contact the release agent contained in the vessel 31 for containing the release agent. The release agent is applied from the release agent applicator on to the sheet P via the heat-fixing roll 1 whereby the release of the sheet p is smoothly executed.

When the release agent is applied on the sheet P by the release agent applicator 3 as illustrated above, it is preferable that the release agent is applied on the heat-fixing roll 1 such that an application quantity of the release agent on to the sheet P is less than $2.0\times10^{-5}$ g/cm$^2$.

When the application quantity exceeds such an uppermost limitation as described above, there is possibility of giving a detrimental effect to a writing property by a ball-point pen or adhesivity by an adhesive tape; this situation is not preferable. Further, when the application quantity is excessively small, the release agent can not fully exert its function; this situation is also not preferable.

As for the release agent, it is preferable to use an organosiloxane which is a silicone composition; it is more preferable to use an organosiloxane compound containing an amino group. Particularly, when an amino-modified silicone oil having a viscosity of from 50 cs to 1000 cs and, more preferably, from 100 cs to 1000 cs at 25° C. is used, a releasing effect can markedly be improved.

Further, the endless belt 2 is stretched among at least 3 support rolls which may be arranged such that one of the support rolls is a displacement roll and other two support rolls are fixed rolls and the displacement roll can displace a position of an axis thereof so as to cross an axis of another fixed roll. By being arranged as described above, it is possible to suppress waving, a wrinkle and breakage of the endless belt 2.

Furthermore, an arrangement may be made such that a central axis of the displacement roll is displaced along an elliptical orbit determined by respective focuses which are central axes of two fixed rolls positioned nearest to the displacement roll in a rotational direction of the endless belt 2 in upstream and downstream sides of the displacement roll. By taking such arrangement, it is possible to fully suppress waving, a wrinkle and breakage of the endless belt 2.

The heat-fixing roll 1may be arranged to form the nip with the endless belt 2 tightly stretched between two fusing rolls. This arrangement can obtain a same fusing ability with less load than a roll-nip system thereby being advantageous for high-speed fusing.

In the upstream side of the pressure roll in the nip region formed by the heat-fixing roll 1 and the endless belt 2, an elastic body roll which press-contacts the heat-fixing roll 1 via the endless belt 2 from inside the endless belt 2 may further be provided. By this arrangement, a function to keep the image to be in a registration position, the self-stripping property, and the fusing property are enhanced.

In a fusing process to be performed by the thus-arranged fusing apparatus, the sheet (transfer material) P having an undeveloped toner image T thereon is transported on to the endless belt 2 and, then, the thus-transported sheet P is advanced to the nip which is formed by the heat-fixing roll 1 which is controlled to have a predetermined temperature and the pressure roll 25 via the endless belt 2, heated in a press-contact state there and, as a result, the toner image T is fixed on the sheet P to finalize the entire fusing process.

ILLUSTRATIVE EMBODIMENTS

The present invention will hereinafter be described more specifically by the following Examples and Comparative Examples. However, the invention should not be interpreted to be limited to these Examples in any way.

Synthesis of Crystalline Polyester Resin

After an acid component containing 5% by mol of dimethyl fumarate, 91% by mol of dimethyl sebacate, and 4% by mol of sodium isophthalic acid dimethyl-5-sulfonate, ethylene glycol (3.5 times the mol of the acid component) and $Ti(OBu)_4$ (0.012% by mass based on the total mass of the acid component) as a catalyst are loaded into a heat-dried two-necked flask, an air pressure inside the flask is reduced by a pressure reduction operation, an inside of the flask is brought into an inert atmosphere and, then, a mixture in the flask is subjected to reflux at 180° C. for 5 hours while stirring.

Then, after an excess quantity of ethylene glycol is removed from the mixture by distillation under reduced pressure, a temperature of the resultant mixture is gradually raised up to 230° C. and the resultant mixture is stirred at this temperature for 2 hours to allow it to be in a viscous state and, thereafter, air-cooled to terminate a reaction; as a result, a polyester is obtained at an yield rate of 89%. The thus-obtained polyester is dissolved in THF (tetrahydrofliran) and, then, precipitated again for purification to obtain the crystalline polyester resin (1) at a yield rate of 84%.

When the thus-obtained crystalline polyester resin (1) is subjected to a molecular weight measurement (as a value converted to polystyrene) by gel permeation chromatography, a mass-average molecular weight ($M_w$) thereof is 10,200 and a number-average molecular weight ($M_n$) thereof is 4,500.

Further, when a melting point of the crystalline polyester resin (1) is measured by a same measurement method as in the above case by using a differential scanning calorimeter (DSC), it shows a distinct peak and a temperature of a crest (also referred to peak-top) thereof is 69° C.

Further, an ester concentration M thereof is calculated as being 0.096.

Synthesis of Crystalline Polyester Resin (2)

After an acid component containing 10% by mol of dimethyl fumarate, and 90% by mol of dimethyl sebacate, ethylene glycol (3.5 times the mol of the acid component) and $Ti(OBu)_4$ (0.01% by mass based on the total mass of the acid component) as a catalyst are loaded into a heat-dried two-necked flask, an air pressure inside the flask is reduced by a pressure reduction operation, an inside of the flask is brought into an inert atmosphere by nitrogen gas and, then, a mixture in the flask is subjected to reflux at 180° C. for 5 hours while being mechanically stirring.

Then, after an excess quantity of ethylene glycol is removed from the mixture by distillation under reduced pressure, a temperature of the resultant mixture is gradually raised up to 230° C. and the resultant mixture is stint at this temperature for 2 hours to allow it to be in a viscous state and, thereafter, air-cooled to terminate a reaction. Before a reaction product becomes solid, THF is added inside the flask and a residual catalyst is removed by a pressure filtration apparatus. As for a purification, the thus-treated reaction product is precipitated again by using TEP/methanol to recover the resultant precipitate, which is then dried under reduced pressure to obtain a crystalline polyester resin (2) at a yield rate of 73%.

When the thus-obtained crystalline polyester resin (2) is subjected to a molecular weight measurement (as a value converted to polystyrene) by gel permeation chromatography, a mass-average molecular weight ($M_w$) thereof is 13,200 and a number-average molecular weight ($M_n$) thereof is 6,000.

Further, when a melting point of the crystalline polyester resin (2) is measured by a same measurement method as in the above case by using a differential scanning calorimeter (DSC), it shows a distinct peak and a temperature of a crest (also referred to peak-top) thereof is 71° C.

Further, an ester concentration M thereof is calculated as being 0.087.

Synthesis of Non-crystalline Polyester Resin (A)

After 100 parts by mol of an add component containing 80% by mol of terephthalic acid, 10% by mol of n-dodecenylsuccinic acid and 10% by mol of trimellitic add, 35 parts by mol of polyoxyethylene(2,0)-2,2-bis(4-hydroxyphenyl)propane, 65 parts by mol of polyoxypropylene(2,2)-2,2-bis(4-hydroxyphenyl)propane and 0.05% by mol of dibutyl tin oxide based on the total mol of the acid component are loaded in a heat-dried flask, a nitrogen gas is introduced inside the flask to hold an inside thereof to be in an inert atmosphere and, then, a temperature of a mixture in the flask is raised and, thereafter, the resultant mixture is subjected to a copolycondensation reaction at a temperature of from 150° C. to 230° C. for about 12 hours; succeedingly, pressure inside the flask is gradually reduced while holding the temperature in a range of from 210° C. to 250° C. to obtain a non-crystalline polyester resin (A) thus copolycondensed.

When the thus-obtained non-crystalline polyester resin (A) is subjected to a molecular weight measurement (as value converted to polystyrene) by gel permeation chromatography, a mass-average molecular weight ($M_w$) thereof is 14,600 and a number-average molecular weight ($M_n$) thereof is 4,700.

Further, when a DSC spectrum of the non-crystalline polyester resin (A) is measured by a differential scanning calorimetry (DSC) in a same way as in the above-described melting point measurement, it does not show a distinct peak and, instead, an endothermic quantity change in a stepped state is observed. A glass transition point, which is positioned at an intermediate point of the endothermic quantity change in a stepped state, is 69° C.

Synthesis of Non-crystalline Polyester Resin (B)

After 100 parts by mol of an acid component containing 75% by mol of terephthalic acid and 25% by mol of fumaric acid, 50 parts by mol of polyoxyethylene (2,0)-2,2-bis(4-hydroxyphenyl)propane, 30 parts by mol of polyoxypropylene(2,2)-2,2-bis(4-hydroxyphenyl)propane and 15 parts by mol of ethylene glycol and 0.05% by mol of dibutyl tin oxide based on the total mol of the acid component are loaded in a heat-dried flask, a nitrogen gas is introduced inside the flask to hold an inside thereof to be in an inert atmosphere and, then, a temperature of a mixture in the flask is raised and, thereafter, the resultant mixture is subjected to a copolycondensation reaction at a temperature of from 150° C. to 230° C. for about 12 hours; succeedingly, pressure inside the flask is gradually reduced while holding the temperature in a range of from 210° C. to 250° C. to obtain a non-crystalline polyester resin (B) thus copolycondensed.

When the thus-obtained non-crystalline polyester resin (B) is subjected to a molecular weight measurement (as value converted to polystyrene) by gel permeation chromatography, a mass-average molecular weight ($M_w$) thereof is 11,800 and a number-average molecular weight ($M_n$) thereof is 3,600.

Further, when a DSC spectrum of the polyester resin (3) is measured by a differential scanning calorimetry (DSC) in a same way as in the above-described melting point measurement, it does not show a distinct peak and, instead, an endothermic quantity change in a stepped state is observed. A glass transition point, which is positioned at an intermediate point of the endothermic quantity change in a stepped state, is 69° C.

Production of Toner (1)

100 parts by mass of the thus-obtained crystalline polyester resin (1) and 1.5 part by mass of lauroyl peroxide are dissolved in 200 parts by mass of tetrahydrofuran to prepare a mixture and, then, 22.5 parts by mass of a 20% by mass toluene dispersion liquid of copper phthalocyanine pigment (C.I. Pigment Blue) is added to the thus-prepared mixture to prepare a dispersion liquid and, thereafter, tetrahydrofuran is removed from the thus-prepared dispersion liquid at 25° C. to prepare 106 parts by mass of a dispersion resin of the pigment and a polymerization initiator.

106 parts by mass of the above-prepared dispersion resin of the pigment and the polymerization initiator is added to 2000 parts by mass of water which has been heated to 80° C. within a flow of nitrogen and emulsified by applying a shear force by means of Ultraturrax at a rate of 8000 rpm for 20 minutes. Thereafter, the resultant emulsion liquid is cooled down to 25° C., added with 20 parts by mass of a release agent dispersion liquid (1) which has been prepared in a manner as described below and, further, dispersed at a rate of 3000 rpm for 5 minutes. Then, a pH of the resultant dispersion/mixture liquid of the resin and the release agent is adjusted to be 2.0 by using 2N nitric acid and the thus-pH-adjusted dispersion/mixture liquid is added with 0.2 part by mass of polyaluminum chloride and stirred at a room temperature. A temperature of the resultant mixture is gradually raised while stirring and, when the mixture reaches 50° C., a pH of this mixture is adjusted to be 7.0 and, further, stirred at 75° C. for 2 hours to proceed an reaction.

Thereafter, the thus-prepared reaction mixture is cooled down to a room temperature, rinsed with a distilled water and dried to obtain 90 parts by mass of toner (1).

Preparation of Release Agent Dispersion Liquid

A mixture containing 50 g of carnauba wax, 5 g of an anionic surfactant (Neogen RK, available from Dai-ichi Kogyo Seiyaku Co., Ltd.) and 200 g of ion-exchanged water is heated to 95° C. and, then, dispersed by using a homogenizer (Ultratrax T50, available from IKA Werke, Janke & Kunkel GmbH); the resultant dispersion liquid is further subjected to a dispersion treatment by a pressure discharge type homogenizer to prepare a release agent dispersion liquid (1) in which the release agent having an average particle size of 500 nm is dispersed.

The thus-obtained toner (1) is subjected to measurements by a Coulter counter TA-II type (aperture: 50 μm diameter, available from Beckman Coulter, Inc.) to find that a volume-average particle size thereof is 5.8 μm and a number-average particle size thereof is 4.9 μm.

Further, when the toner (1) is added to tetrahydrofuran the toner (1) remains undissolved therein. Ordinarily, since the crystalline polyester resin is easily dissolved in the above-described solvent, it is assumed that a crosslink structure is formed in the toner (1).

Production of Toner (2)

100 parts by mass of the thus-obtained crystalline polyester resin (1) and 2 parts by mass of lauroyl peroxide are dissolved in 200 parts by mass of tetrahydrofuran to prepare a mixture and, then, terahydrofuran is removed therefrom at 25° C. to prepare 102 parts by mass of a dispersion resin of a polymerization initiator.

102 parts by mass of the above-prepared dispersion resin of the polymerization initiator is added to 2000 parts by mass of water which has been heated to 80° C. under a flow of nitrogen and emulsified by applying a shear force by means of Ultraturrax at a rate of 8000 rpm for 30 minutes. Thereafter, the resultant emulsion liquid is cooled down to 25° C. and, then, a pH of the emulsion liquid is adjusted to be 2.0 by using 2N nitric acid; succeedingly, the thus-pH-adjusted emulsion liquid is added with 22.5 parts by mass of an aqueous liquid in which 5 parts by mass of C.I. Pigment Blue is dispersed, 20 parts by mass of the dispersion liquid of the release agent (1) and 0.2 part by mass of polyaluminum chloride and stirred at a room temperature. A temperature of the resultant mixture is gradually raised while stirring and, when the mixture reaches 50° C., a pH of this mixture is adjusted to be 7.0 and, further, stored at 75° C. for 2 hours to proceed an reaction.

Thereafter, the thus-prepared reaction mixture is cooled down to a room temperature, rinsed with a distilled water and dried to obtain 90 parts by mass of toner (2).

The thus-obtained toner (2) is subjected to measurements by a Coulter counter TA-II type (aperture: 50 μm diameter, available from Beckman Coulter, Inc.) to find that a volume-average particle size thereof is 4.8 μm and a number-average particle size thereof is 3.5 μm.

Further, when the toner (2) is added to tetrahydrofuran, since the toner (2) remains undissolved therein, it is assumed that a crosslink structure is also formed in the toner (2).

Production of Toner (3)

100 parts by mass of the thus-obtained crystalline polyester resin (1) is added in 1900 parts by mass of ion-exchanged water and emulsified by applying a shear force by means of Ultraturrax at a rate of 10,000 rpm at 80° C. for 10 minutes to obtain a dispersion liquid. Thereafter, the resultant dispersion liquid is cooled down to 40° C. and, then, added with 24 parts by mass of the dispersion liquid of the release agent (1) and, further, dispersed by stirring at a rate of 3000 rpm for 5 minutes.

250 parts by mass of the resultant dispersion/mixture liquid is cooled down to 25° C. and, then, added with 2.7 parts by mass of a 25% by mass of copper phthalocyanine aqueous solution under a flow of nitrogen and a pH of the resultant mixture is adjusted to be 2.0 by using 2N nitric acid and, further, added with 0.2 part by mass of polyaluminum chloride (10% by mass aqueous solution), 3.3 parts by mass of an ethyl acetate solution of 18% by mass of lauroyl perchloride and stilled at a room temperature. A temperature of the resultant mixture is gradually raised while stirring and, when the mixture reaches 50° C., a pH of this mixture is adjusted to be 7.0 and, further, stir at 75° C. for 3 hours to proceed an reaction.

Thereafter, the thus-prepared reaction mixture is cooled down to a room temperature, rinsed with a distilled water and dried to obtain 12.5 parts by mass of toner (3).

The thus-obtained toner (3) is subjected to measurements by a Coulter counter TA-II type (aperture: 50 μm diameter, available from Beckman Coulter, Inc.) to find that a volume-average particle size thereof is 4.6 μm and a number-average particle size thereof is 3.3 μm.

Further, when the toner (3) is added to tetrahydrofliran, since the above-described toner (3) remains undissolved therein, it is assumed that a crosslinking structure is formed in the toner (3).

Production of Toner (4)

80 parts by mass of the thus-obtained crystalline polyester resin (2), 4 parts by mass of C. I. Pigment Blue 15:3 and 75 parts by mass of ethyl acetate are mixed and dispersed by a sand mill to prepare a dispersion liquid.

A 1.0% by mass aqueous solution of carboxymethyl cellulose is added with 20 parts by mass of calcium carbonate and 20 parts by mass of the release agent dispersion liquid (1) and subjected to nitrogen bubbling. The resultant mixture is added with 100 parts by mass of the above-prepared dispersion liquid at 50° C. and stirred at a rate of 10,000 rpm for 5 minutes to obtain a suspension liquid. While the thus obtained suspension liquid is further stirred under a flow of nitrogen, a solution in which 1.5 parts by mass of 2,2'-azobisisobutyronitfile (polymerization initiator) is dissolved in 22 parts by mass of toluene is added to the suspension liquid and, then, subjected to a reaction at 80° C. for 1.0 hour and, while being further stirred, cooled down to 40° C. in a water bath to terminate the reaction, that is, suspension polymerization whereupon a crosslinked particle dispersion liquid is obtained The thus-obtained crosslinked particle dispersion liquid is added with water of about 5 times the quantity thereof and then, after calcium carbonated contained in this dispersion liquid is dissolved by hydrochloride, the dispersion liquid is rinsed with water plural times to obtain a mixture of water and a toner. In a last step, water is evaporated to obtain a toner (4).

The thus-obtained toner (4) is subjected to measurements by a Coulter counter TA-II type (aperture: 50 μm diameter, available from Beckman Coulter, Inc.) to find that a volume-average particle size thereof is 6.7 μm and a number-average particle size thereof is 6.0 μm Further, when the toner (4) is added to tetrahydrofiran, since the toner (4) remains undissolved therein, it is assumed that a crosslink structure is formed also in the toner (4).

Production of Toner (5)

84 parts by mass of the thus-obtained non-crystalline polyester resin (A) and 16 parts by mass of copper phthalocyanine pigment (C. I. Pigment Blue 15:3) are melt-kneaded by a Banbury-type kneader to prepare a densely colored resin composition. 20 parts by mass of the thus-obtained densely colored resin composition, 5 parts by mass of carnauba wax and 75 parts by mass of the non-crystalline polyester resin are dispersed/dissolved in 100 parts by mass of ethyl acetate to prepare a dispersion solution.

200 parts by mass of the thus-obtained dispersion solution is added to a mixture liquid containing 1 part by mass of carboxymethyl cellulose, 20 parts by mass of calcium carbonate and 100 parts by mass of water and, then, dispersed by a high speed mixing operation by means of a mixer to obtain an emulsion liquid. The thus-obtained emulsion liquid is loaded in a beaker and, then, added with water of about 5 times the quantity thereof and, thereafter, held in a water bath at 45° C. for 10 hours while stirring to evapolate ethyl acetate contained therein; succeedingly, after calcium carbonate contained therein is dissolved by hydrochloride, the emulsion liquid is rinsed with water plural times to obtain a mixture of water and a toner. In a last step, water is evaporated to obtain a toner (5).

The thus-obtained toner (5) is subjected to measurements by a Coulter counter TA-II type (aperture: 50μ diameter, available from Beckman Coulter, Inc.) to find that a volume-average particle size thereof is 7.8 μm and a number-average particle size thereof is 7.0 μm Production of Toner (6)

84 parts by mass of the thus-obtained non-crystalline polyester resin (B), 16 parts by mass of copper phthalocyanine pigment (C. I. Pigment Blue 15:3) are melt-kneaded by a Banbury type kneader to obtain a densely colored resin composition. 20 parts by mass of the thus-obtained densely colored resin composition, 5 parts by mass of carnauba wax and 75 parts by mass of the non-crystalline polyester resin are disperse/dissolved in 100 parts by mass of ethyl acetate to prepare a dispersion solution.

200 parts by mass of the thus-obtained dispersion solution is added to a a mixture liquid containing 1 part by mass of carboxymethyl cellulose, 20 parts by mass of calcium carbonate and 100 parts by mass of water and, then, dispersed therein by a high speed mixing operation by means of a mixer to obtain an emulsion liquid. The thus-obtained emulsion liquid is loaded in a beaker and, then, added with water of about 5 times the quantity thereof and, thereafter, held in a water bath at 45° C. for 10 hours while stirring to evaporate the above-described ethyl acetate contained therein; succeedingly, after calcium carbonate contained therein is dissolved by hydrochloride, the emulsion liquid is rinsed with water plural times to obtain a mixture of water and a toner. In a last step, water is evaporated at 45° C. by a vacuum dryer to obtain a toner (6).

The thus-obtained toner (6) is subjected to measurements by a Coulter counter TA-II type (aperture: 50 μm diameter, available from Beckman Coulter, Inc.) to find that a volume-average particle size thereof is 7.2 μm and a number-average particle size thereof is 6.8 μm Evaluation of Properties Properties of the thus-obtained toners (1) to (6) are evaluated in accordance with methods described below. Results are also included in Table 1.

Measurement of Melting Point

A melting point (Tm) of each of the toners (1) to (6) is determined by using a thermal analyzer, that is, a differential scanning calorimeter (DSC 3110, Thermal Analysis System 001, available from MAC Science Co., Ltd.) (hereinafter referred to as "DSC"). Measurements are performed over a temperature range of from a room temperature to 150° C. at a temperature-raising rate of 10° C. a minute. The melting point is obtained by conducting an analysis in accordance with JIS K-7121. On this occasion, since toners (5) and (6) do not exhibit a distinct melting point, each glass transition point (Tg) is described, instead.

Measurement of Viscoelasticity

Viscoelasticity of each of the toners (1) to (6) are determined using a rotary rheometer with plates (RDA 2RHIOS System ver. 4.3.2, available from Rheometric Scientific F.E.Ltd.).

Measurements are conducted by setting each toner for electrophotography in a sample holder under conditions that a rate of temperature rise is 1° C./minute, a frequency is 1 rad/s, a strain is 20% or less and a detection torque is within a measurement proof value. A size of the sample holder is adjusted to either 8 mm or 20 mm as require Specific contents of such measurements include storage elastic modulus $G_L$ (30) and loss elastic modulus $G_N$ (30) at 30° C., as well as changes of the storage elastic modulus $G_L$ and the loss elastic modulus $G_N$ along with changes of temperatures.

Further, in regard to each of the toners (1) to (6), a value obtained by dividing the loss elastic modulus GN at 120° C. by the measured frequency 1 rad/s is determined as melt viscosity.

TABLE 1

| | Toner (1) | Toner (2) | Toner (3) | Toner (4) | Toner (5) | Toner (6) |
|---|---|---|---|---|---|---|
| Kinds of polyester resins | (1) | (1) | (1) | (1) | (1) | (1) |
| Melting point Tm (° C.) | 69 | 69 | 68 | 71 | 69 (Tg) | 67 (Tg) |
| Storage elastic modulus $G_L$ (30) | $4.3 \times 10^7$ | $4.7 \times 10^7$ | $2.6 \times 10^7$ | $3.0 \times 10^8$ | $2.3 \times 10^9$ | $3.2 \times 10^9$ |
| Loss elastic modulus $G_N$ (30) | $4.9 \times 10^6$ | $5.6 \times 10^6$ | $4.7 \times 10^6$ | $7.3 \times 10^7$ | $4.3 \times 10^7$ | $4.3 \times 10^7$ |
| $LogG_N$ (90)-$LogG_N$ (120) | 0.76 | 0.53 | 0.83 | 1.21 | 2.21 | 3.74 |
| Presence or absence of temperature area having changes of 1000 or more | ○ | ○ | ○ | ○ | × | × |
| Melt viscosity at 120° C. (Pa · s) | 450 | 520 | 370 | 1200 | 3200 | 2700 |

EXAMPLE 1

The thus-obtained toner (1) is added with 1.5 part by mass of titania fine powders based on 100 parts by mass of the toner and mixed by a Henschel mixer to obtain a toner for electrostatic charge development. 5 parts by mass of the thus-obtained toner and 100 parts by mass of a carrier which is prepared by a method described below are mixed with each other to prepare a two-component developer (1).

Preparation of Carrier 0.12 part by mass of carbon black (under trade name of VXC-72, available from Cabot Corporation) is mixed to 1.25 part by mass of toluene and is stir-dispersed by a sand mill for 20 minutes to prepare a carbon black dispersion liquid; then, a coating agent resin solution prepared by mix-stirring the thus-prepared carbon black dispersion liquid and 1.25 part by mass of an 80% by mass ethyl acetate solution of tri-functional isocyanate (Takenate D110N, available from Mitsui Takeda Chemicals, Inc.) and 100 parts by mass of Mn-Mg-Sr ferrite particles (average particle size being 35 μm) are loaded in a kneader and subjected to mix-stirring at a normal temperature for 5 minutes; thereafter, a temperature of the resultant mixture is raised to 150° C. under a normal pressure to remove a solvent contained therein. Then, after the thus-solvent-removed mixture is further mix-stirred for 30 minutes, power of a beater is turned off to lower a temperature of the mixture down to 50° C. thereby preparing a coat carrier. The thus-prepared coat carrier is filtered with a sieve of 75 μm mesh to produce a carrier.

The thus-produced two-component developer (1) is allowed to perform an image formation by a commercial electrophotographic copying machine (A-Color 635, available from Fuji Xerox Co., Ltd.) from which a fusing apparatus has previously been removed thereby obtaining an unfused image. On this occasion, as for a transfer material on which the unfused image is formed, J paper from Fuji Xerox Co., Ltd. is used. The thus-formed unfused image is of a solid image.

Next, the thus-formed unfused image is fused by using a nip-belt type external fixing apparatus which is described below.

Fusing Apparatus

Fusing of the unfixed image is performed by using a fusing apparatus shown in FIG 2. Specifically, a heat-fixing roll 1 is a roll which is prepared by coating a hollow roll 12 made of aluminum cylinder having an outer diameter of 46 mm and an inner diameter of 40 mm with a HTV silicone rubber (rubber hardness of 45 degrees) in a thickness of 2 mm as an underlying layer 13, dip-coating the thus-coated hollow roll with a silicone RTV rubber in a thickness of 50 μm as a top-coat layer 14 and finishing the top-coat layer so as to allow a surface of the thus-dip-coated hollow roll to be in a mirror state. As for a heat source, a halogen lamp of 400W is utilized. A surface of the heat-fixing roll 1 is controlled by a temperature controller via a temperature sensor 15.

On the other hand, an endless belt 2 is a polyimide film having a thickness of 7.5 μm and is tightly stretched among three support rolls 21, 21 and 23, each of which is made of stainless steel and has a diameter of 25 mm, and a pressure roll 25 with a tension of 10 kg. The pressure roll 25 has a diameter of 18 mm. A winding angle of the endless belt 2 to the heat-fixing roll 1is set to be 45 degrees.

Evaluation of Fusing Performance

A fusing performance is evaluated according to a method described below. Fusing conditions are as follows:

Nip load (nip pressure) is 20 kg; and process speed is 100 mm/sec and 200 mm/s. Evaluation results are included in Table 2.

Evaluation of Low-temperature Fusing Property and Hot Offset Property

While a fusing temperature is raised from 120° C. to 220° C. in a stepped manner, a low-temperature fusing property and a hot offset property are evaluated.

As for the low-temperature fusing property, a fused image (25 mm×25 mm) is folded by using a weight having a given load, a rate of image failure on a folded portion is graded and a fusing temperature at which the rate of image failure reaches a given grade or higher is determined as a minimum fusing temperature; on this occasion, the minimum fusing temperature is set as a reference of the low-temperature fusing property.

On the other hand, as for the hot offset property, immediately after the unfused image is passed through the fusing apparatus at each temperature, one sheet of blank paper on which no image is formed is passed therethrough; when the toner is offset on the fusing roll, a toner after-image remains on the sheet; on this occasion, presence or absence of such toner after-image on the sheet is set as a reference of the hot offset property.

Evaluation of Gloss

While the fusing temperature is raised from 120° C. to 220° C. in a stepped manner, a solid image is fused at each step of temperature. Respective glossiness of three given points on each solid image thus fixed are determined using a gloss meter (GM-26D, available from Murakami Color Research Laboratory) and an average of the thus-determined respective glossiness is set as gloss (image glossiness) at a specified step of temperature.

Evaluation of Adhesive Property to Paper

The obtained fused image is subjected to an abrasion test by a rubber eraser (ST-100, available from Tanaka Rubber Ind., Ltd.) 10 times in a reciprocating manner. Whether or not the fused image is separated from the paper is observed to evaluate the adhesive property to the paper.

EXAMPLE 2

A two-component developer is prepared in a same manner as in Example 1, except that the toner (1) is replaced by the toner (2); fusing is performed in a same manner as in Example 1, except that an unfused image is formed using the thus-prepared two-component developer, a fusing performance of the thus-fused image is evaluated. Results are shown in Table 2.

EXAMPLE 3

A two-component developer is prepared in a same manner as in Example 1, except that the toner (1) is replaced by the toner (3); fusing is performed in a same manner as in Example 1, except that an unfused image is formed using the thus-prepared two-component developer, a fusing performance of the thus-fused image is evaluated. Results are shown in Table 2.

EXAMPLE 4

A two-component developer is prepared in a same manner as in Example 1, except that the toner (1) is replaced by the toner (4); fusing is performed in a same manner as in Example 1, except that an unfused image is formed using the thus-prepared two-component developer; a fusing performance of the thus-fused image is evaluated. Results are shown in Table 2.

COMPARATIVE EXAMPLE 1

A two-component developer is prepared in a same manner as in Example 1, except that the toner (1) is replaced by the toner (5); fusing is performed in a same manner as in Example 1, except that an fused image is formed using the thus-prepared two-component developer, a fusing performance of the thus-fused image is evaluated. Results are shown in Table 2.

COMPARATIVE EXAMPLE 2

A two-component developer is prepared in a same manner as in Example 1, except that the toner (1) is replaced by the toner (6); fusing is performed in a same manner as in Example 1, except that an unfused image is formed using the thus-prepared two-component developer, a fusing performance of the thus-fused image is evaluated. Results are shown in Table 2.

TABLE 2

| | Fixing rates (mm/sec) | Low-temperature fixing properties: Minimum Fixing Temperatures | Evaluations (*) | Hot offset properties: Generation temperatures | Evaluations (*) | Gloss: Gloss ranges | Evaluations (*) | Adhesivity to paper | Comprehensive evaluation |
|---|---|---|---|---|---|---|---|---|---|
| Example 1 | 100 | 100 | ○○ | 220 | ○ | 20–75 | ○ | Favorable | ○ |
| | 200 | 100 | ○○ | 220 | ○ | 10–65 | ○ | | ○ |
| Example 2 | 100 | 90 | ○○ | 210 | ○ | 25–90 | ○ | Favorable | ○ |
| | 200 | 90 | ○○ | 210 | ○ | 15–65 | ○ | | ○ |
| Example 3 | 100 | 100 | ○○ | 220 | ○ | 20–85 | ○ | Favorable | ○ |
| | 200 | 100 | ○○ | 220 | ○ | 15–70 | ○ | | ○ |
| Example 4 | 100 | 100 | ○○ | 220 | ○ | 25–80 | ○ | Favorable | ○ |
| | 200 | 100 | ○○ | 220 | ○ | 15–65 | ○ | | ○ |
| Comparative | 100 | 110 | ○○ | 180 | × | 20–80 | ○ | Favorable | × |
| Example 1 | 200 | 140 | × | 200 | ○ | 15–50 | × | | × |
| Comparative | 100 | 110 | ○○ | 180 | × | 15–80 | ○ | Favorable | × |
| Example 2 | 200 | 130 | × | 190 | Δ | 10–50 | Δ | | × |

(*): Symbols ○○, ○, Δ and × indicate "Satisfactory", "Fairly satisfactory", "Rather unsatisfactory" and "Unsatisfactory", respectively.

As is apparent from Table 2, according to Examples 1 to 4 which each use the toner containing the crystalline polyester resin as the principal component of the binder resin, stable and favorable evaluations on all of the low-temperature fusing property, the hot offset property and a gloss switching property can be obtained independently of fusing rates.

In contrast, according to Comparative Examples 1 and 2 which each use the toner containing the non-crystalline polyester resin as the principal component of the binder resin, at a process speed of 100 mm/s, though there is no problem in the low-temperature fusing property, there is a problem in the hot offset property, since the fused image contacts a fusing apparatus for a prolonged time. Further, at a process speed of 200 mm/s, though there is little detrimental effect to the hot offset property and an anti-peeling-off property, there is a problem in the low-temperature fusing property, since heat is not sufficiently added to the image.

Further,in the evaluation on the adhesivity to paper, since all of the toners to be used in Examples and Comparative Examples each individually have an ester concentration in a range of from 0.01 to 0.2, the image is not separated from the paper when rubbed with a rubber eraser to exhibit a favorable adhesivity to paper.

According to the present invention, a method of forming an image in which the image can be formed at a high speed, the low-temperature fusing property and the offset resistance are compatible and, further, gloss can be controlled can be provided The entire disclosure of Japanese Patent Application No. 2001-218266 filed on Jun. 18, 2001 including specification, claims, drawings and abstract is incorporated herein by reference in its entirety.

What is claimed is:

1. A method of forming an image, comprising a developing step of forming a toner image by developing an electrostatic latent image formed on a latent image holding member by a developer containing a toner;

a transferring step of transferring the toner image formed on the latent image holding member onto a transfer material; and a fusing step of fusing the toner image transferred on the transfer material, wherein the toner comprises at least a colorant and a binder resin in which a principal component is a crystalline resin; and the fusing step is performed by a fusing apparatus comprising a heat-fixing roll and an endless belt, the heat-fixing roll comprising a cylindrical core metal coated with a heat resistant elastic body layer and a heat resistant resin layer in this order and the endless belt having a pressure member inside, forms a nip by winding the endless belt round the heat-fixing roll at a predetermined angle thereby allowing a recording sheet to pass through between the endless belt and the heat-fixing roll, and generates strain on the heat resistant elastic body layer of the heat-fixing roll by urging the pressure member against the heat-fixing roll via the endless belt in the nip.

2. The method of forming the image as set forth in claim 1, wherein the toner image is formed by the toner in the developer comprising the toner and a carrier and wherein the carrier has a nitrogen-containing resin coating.

3. The method of forming the image as set forth in claim 1, wherein the heat resistant elastic body layer is coated on the heat-fixing roll by a thickness of 0.5 mm or more.

4. The method of forming the image as set forth in claim 1, wherein a quantity $\epsilon$ of the strain in a circumferential direction of the heat resistant elastic body layer satisfies the following relative formula:

$$\epsilon \geqq 0.5\%.$$

5. The method of forming the image as set forth in claim 1, wherein a storage elastic modulus $G_L(90)$ of the toner and a loss elastic modulus $G_N(90)$ of the toner at an angular frequency of 1 rad/s and 90° C. are $1\times10^5$ Pa or less, and a storage elastic modulus $G_L(120)$ of the toner and a loss elastic modulus $G_N(120)$ of the toner at an angular frequency of 1 rad/s and 120° C. are $1\times10^5$ Pa or less, and a relation between the storage elastic modulus $G_L(90)$ of the toner and the storage elastic modulus $G_N(120)$ of the toner satisfies the following formula (1):

$$\log G_L(90)-\log G_L(120)<2 \quad (1).$$

6. The method of forming the image as set forth in claim 1, wherein a melt viscosity of the toner at 120° C. is 100 Pa·S or more.

7. The method of forming the image as set forth in claim 1, wherein a melting point of the crystalline resin is from approximately 50° C. to approximately 120° C.

8. The method of forming the image as set forth in claim 1, wherein the crystalline resin is a crystalline polyester resin.

9. The method of forming the image as set forth in claim 8, wherein an ester concentration M defined by the following formula (2) of the crystalline polyester resin is from approximately 0.01 to approximately 0.2:

$$M=K/A \quad (2)$$

wherein

M represents an ester concentration;

K represents a number of ester groups in a polymer, and

A represents a number of atoms constituting a polymer chain of the polymer.

10. The method of forming the image as set forth in claim 8, wherein the crystalline polyester resin is an aliphatic polyester resin.

11. The method of forming the image as set fort in claim 1, wherein the toner is prepared by emulsifying the binder resin and adjusting a toner diameter by agglomerating and coalescing the emulsified binder resin.

12. The method of forming the image as set fork in claim 1, wherein the toner adds a release agent internally by from approximately 0.5% by mass to approximately 50% by mass.

13. The method of forming the image as set forth in claim 1, wherein a storage elastic modulus $G_L(30)$ of the toner is $1\times10^6$ or more and a loss elastic modulus $G_N(30)$ of the toner is $1\times10^6$ or more at an angular frequency of 1 rad/s and 30° C.

14. The method of forming the image as set forth in claim 1, wherein the toner has an area of temperature in which a change of a value of the storage elastic modulus $G_L$ and the loss elastic modulus $G_N$ is 1000 or more in a temperature range of 10° C.

15. The method of forming the image as set forth in claim 1, wherein the toner comprises two or more types of external additives and wherein an average primary particle size of at least one type of the external additives is in a range of from approximately 30 nm to approximately 200 nm.

16. The method of forming the image as set forth in claim 2, wherein the nitrogen-containing resin is selected from the group of a urea resin, a urethane resin, a melamine resin, an amide resin and mixtures thereof.

* * * * *